United States Patent [19]

Kobayashi et al.

[11] Patent Number: 4,727,684

[45] Date of Patent: Mar. 1, 1988

[54] FULL-AUTOMATIC WORK FINISHING MACHINE WITH HIGH-SPEED ROTATING BARREL CONTAINERS

[75] Inventors: Hisamine Kobayashi; Toshiharu Shimizu; Yoichi Seo, all of Nagoya, Japan

[73] Assignee: Tipton Manufacturing Corporation, Nagoya, Japan

[21] Appl. No.: 877

[22] Filed: Jan. 6, 1987

[30] Foreign Application Priority Data

Jan. 16, 1986 [JP] Japan ..... 61-6816

[51] Int. Cl.[4] ..... B24B 31/02

[52] U.S. Cl. ..... 51/164.2; 241/137; 51/5 R

[58] Field of Search ..... 51/164.2, 5; 241/137, 241/171

[56] References Cited

U.S. PATENT DOCUMENTS

| | | | |
|---|---|---|---|
| 3,823,512 | 7/1974 | Kobayashi | 51/164.2 |
| 3,855,740 | 12/1974 | Kobayashi | 51/164.2 |
| 4,104,831 | 8/1978 | Kobayashi | 51/164.2 |
| 4,505,072 | 3/1985 | Kobayashi et al. | 51/164.2 |
| 4,665,661 | 5/1987 | Kobayashi et al. | 51/164.2 |

*Primary Examiner*—Harold D. Whitehead

*Attorney, Agent, or Firm*—Wenderoth, Lind & Ponack

[57] ABSTRACT

A high-speed work finishing machine includes a plurality of work finishing units each supported by a high-speed turret for carrying barrel containers to be driven for both orbital and axial rotations. It further includes a circulating transport path for carrying a barrel container from the unloading location where it is to be demounted from a work finishing unit to the loading location where it is to be mounted to the same unit, and various means disposed along the circular transport path between the unloading and loading locations, those means involving the handling of a barrel container and/or the works and abrasive media under the control of a central programmable sequential controller.

4 Claims, 36 Drawing Figures

FULL-AUTOMATIC WORK FINISHING MACHINE WITH HIGH-SPEED ROTATING BARREL CONTAINERS

BACKGROUND OF THE INVENTION

1. Field of the Invention

The present invention relates generally to a machine that includes barrel containers which contain works to be processed together with the abrasive media that may include any required compound solution, in which the barrel containers are driven for both axial and orbital rotations with high speeds so that the works therein can be subjected to the surface finishing, deburring, or other surface treating processes. More specifically, the present invention makes all the machine operations completely automatic, including the preliminary operation and the final operation.

2. Description of the Prior Art

There is a conventional work finishing machine that includes high-speed rotating barrel containers, which is fully automatic but is primarily designed for the wet-type finishing operation. The dry-type finishing machine has not yet been developed. The conventional machine includes means that permits mounting or demounting of a barrel container, which usually requires the human operator's intervention. All operations including the barrel container mounting or demounting are cyclic, but are not automatic from one cycle to another. That is, the operation is not completely unmanned or unattended.

In order to safisfy the requirements for the total system that includes a plurality of individual work finishing units of the kind mentioned above and permits the use of abrasive media for the dry-type work finishing as well as for the wet-type work finishing, whereby all the operations can be performed under the completely unmanned or unattended environment, it is observed that there are many problems yet to be solved.

One problem occurs when a barrel container is to be mounted or demounted. Specifically, the problem is how to mount or demount a barrel container without the operator intervention and how to lock it on the machine. Other problems include how to reactivate the used abrasive media in order to retain its abrading capability, how to keep the abrasive media warm to retain its abrading capability, how to transport individual barrel containers into or out of the system and how to place works into those barrel containers, and a controller required to run the total system with high efficiency.

SUMMARY OF THE INVENTION

The present invention offers the solutions to the above-mentioned problems.

Specifically, the total system is provided which includes a plurality of individual work finishing units, wherein individual barrel containers are built to allow them to be mounted or demounted on the appropriate unit, and a conveyer such as a roller conveyer is provided to run around the system on which the individual barrel containers that have left the units are to travel. Furthermore, means is provided for unstacking the barrel containers (for the multiply-stacked containers), means is provided for turning over the containers so that the contents therein can be removed, means is provided for separating those contents into works and abrasive media, means is provided for measuring and supplying quantities of abrasive media, means is provided for reactivating the used media that have reduced their abrading capability by supplying any reactivating substance so that they can be reused, means is provided for brush-cleaning the flanges of the containers and keeping their lids closed hermetically or airtight, means is provided for applying heating to the media so that they are kept at a constant temperature and can be used under the uniform abrading conditions, means is provided for placing works to be processed into the containers, and means is provided for stacking one container over another (for the multiply-stacked containers). Those means are arranged in the appropriate positions around the conveyer which is running around the system. In addition, the system contains means that controls the above-listed means and the individual work finishing units so that they can run efficiently. For example, this control means may include FFS (Flexible Finishing System) that controls the mounting of a specific barrel container containing works next to be processed, onto a specific work finishing unit that has finished its operation and is now ready for a next operation.

Generally, the work-surface finishing machine has individual barrel containers, each of which contains works and their abrading media (which are collectively referred to as "mass"). The barrel containers are placed on a turret which is driven for high-speed rotation, and are also supported by their respective shafts for axial rotation. Thus, each individual barrel container has both orbital and axial rotations, during which the mass is subjected to the centrifugal forces which produce a sliding layer on the surface of the mass. Then, the works and abrasive media composing the mass have their relative motion, which causes both elements to interact with each other, so that the works can have their surfaces finished.

The specific features of the present invention include the individual barrel containers that are configured to allow them to be mounted or demounted on the corresponding work finishing unit, the provision of a manipulator that handles a barrel container for its loading and unloading on one and the other sides of the unit, the provision of a barrel container conveyer that runs from the unloading manipulator to the loading manipulator, and the provision of a manipulator that handles a barrel container on the way of the conveyer for its stacking or unstacking. Other features include a mass separator that physically separates the finished works and their abrasive media, a device that measures and supplies quantities of abrasive media, a media blender, a device that measures and supplies quantities of reativating substances, a device that brush-cleans the flange of a barrel container, a heater that applies heating to the media, means that places new works into a barrel container, and a manipulator that handles barrel containers when stacked. A probrammable sequence controller is also provided for controlling the sequential operation of the above-listed devices. Thus, the present invention provides the well-managed, completely automatic operating environment.

The abrasive media used for the above-described operation may include either wet-type or dry-type media. A single barrel container may be used, or multiply-stacked barrel containers may be used.

As its constructional features are summarized above, the work-surface finishing machine includes a plurality of individual units that provide similar work finishing functions, to each of which barrel containers are provided mountably or demountably. Those barrel containers travel on the circulating conveyer, around which the associated devices as mentioned above are arranged. The FFS provides the control center that controls all the operations of the involved devices. Thus, the completely unmanned operation can be achieved, starting with charging works into a barrel container through all the intervening operations and ending with discharging the finished works from the container.

BRIEF DESCRIPTION OF THE DRAWINGS

Those and other objects, features and advantages of the present invention will be made clear from the detailed description of several preferred embodiments that will follow hereinafter by referring to the accompanying drawings, in which:

FIG. 16 (*b*) indicates the location of a micro switch that is responsive to the turnover of the barrel container;

FIG. 25 being a front view of the device,

FIG. 26 being a plan view thereof,

FIG. 27 being a front view of a stirring device,

FIG. 28 being a side elevation thereof,

FIG. 29 being a front view of an oil measuring and supplying device, and

FIG. 30 being an enlarged sectional view of the principal part;

DETAILED DESCRIPTION OF THE PREFERRED EMBODIMENTS

Figure 1:
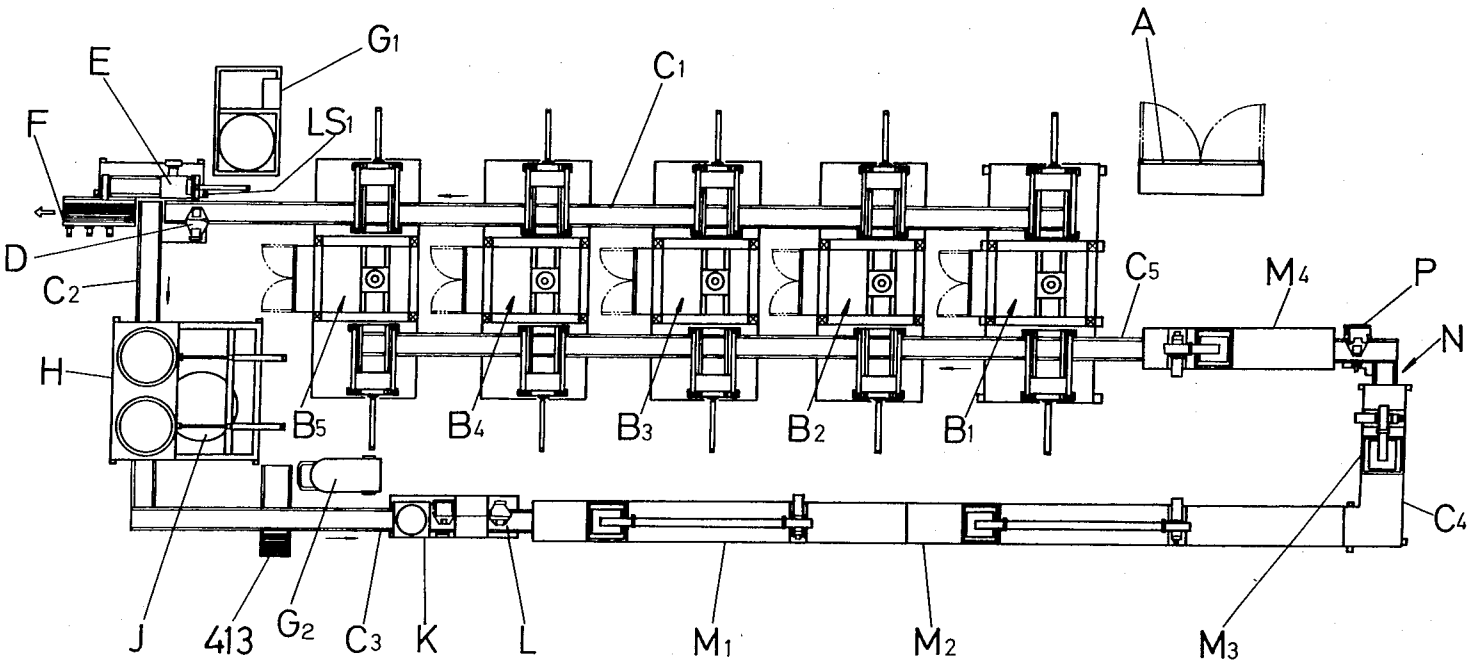
FIG. 1 illustrates the general construction of the machine according to the present invention, including individual work finishing units that are arranged in their designated positions.

FIG. 1 is a plan view of a preferred embodiment of the present invention. Referring first to FIG. 1, the present invention is described in terms of its general construction.

Figure 2:
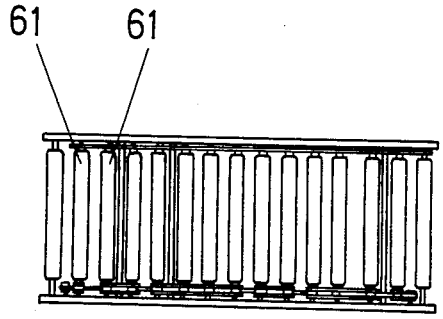
FIG. 2 is a plan view of a conveyer, showing its construction.
Figure 3:
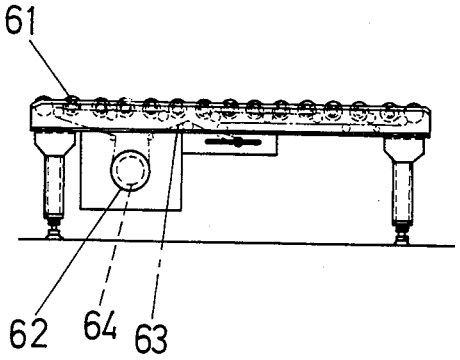
FIG. 3 is a side elevation of the conveyer in FIG. 2.

Designations B1 through B5 refer to individual work finishing units. It is shown in FIG. 1 that five such units are installed, but the number of units may be varied. In the following description, capital letter A, B, C and so on are reffered to the working apparatuses which have the appropriate functions or facilities and suffixes mean digits. A barrel container, which contains works to be processed and abrasive media, is introduced into the system from one side thereof (below) and then mounted onto an appropriate work finishing unit, and upon completion of the finishing operation, it leaves the work finishing unit from the other side (above). Then, the barrel container is placed onto a roller conveyer C1 which transports it toward the left. For the multiply-stacked barrel containers, they are unstacked by a manipulator D which is provided for the barrel unstacking. A single barrel container or each of the unstacked containers is then reversed by a manipulator E, and the contents are removed from the container onto a mass separator F, where they are separated into works and abrasive media. The empty container is moved down onto a conveyer C2. The works are delivered to the next following process, and the media are delivered through a vacuum system G1 back into a media tank H. The media tank H normally contains the media that have been used and returned, but initially or when the media have been obsolete, new or additional media that have been blended by a media blender J is delivered through a vacuum system G2 into the media tank H. The barrel container on the conveyer C2 then has the quantity of media, which is measured and fed from the media tank H, and is transferred onto a conveyer C3. The barrel container travels on the conveyer C3 to a reactivating substance supply K where the ingredients of the media, particularly abrasive and oils, that have been consumed during the previous finishing operation, are added to the media. Then, the barrel container has its flange brush-cleaned by a barrel brushing device L, where it is also kept hermetic or airtight before it is remounted on the appropriate work finishing unit. Then, the barrel container travels on the conveyer C3 to a media heater M1, M2, where the media contained in the container is heated to a certain temperature, which is required so that the media can be used under the temperature requirements for the optimum work finishing. Following this, the barrel container is moved onto a conveyer C4, on which it travels through a heater M3 toward a location N where works to be processed are to be placed into the barrel container. Leaving the location N, the barrel container then travels on a conveyer C5 to a manipulator P which handles multiply-stacked barrel containers. If necessary, the barrel containers are stacked by the manipulator P, and are delivered to a heater M4. The heater M4 is provided so that the single or multiple containers can be kept constantly warm before it or they are mounted on the work finishing unit. In response to an instruction issued from a main controller A, the barrel container (or multiply-stacked containers) is moved to a work finishing unit that is in the wait state and is now ready for run, and is mounted on that unit. After it is mounted, the work finishing process proceeds. The main controller A incorporates the FFS electronic circuitry that provides the sequential control functions for the above-listed units and devices. One example of the conveyer construction is illustrated in FIGS. 2 and 3. As shown, the conveyer is a roller conveyer, which is equipped with a number of rollers 61, 61, etc., which are arranged along the conveyer path and are driven by means of a chain 63 which is threaded around a sprocket wheel 64, which is rigidly secured to a shaft of a motor 62. A group of such conveyers C1, C2, C3, C4, and C5 is provided as described, each of which is driven by the above power drive mechanism. When the barrel container on any of the conveyers is to be stopped in position, a stop 33 (see FIG. 8) is provided before that stop position, which is controlled by a fluid-operated cylinder. The stop 33 is raised through the conveyer by actuating the cylinder. In this case, the conveyer may be moving.

The construction and operation of each of the above-described units and devices are described. In the following description, it should be noted that different groups such as A, B, C, etc. have been given different numerical designations which are increased by hundreds. For example, those parts or elements that belong to the work finishing units B1 to B5 and roller conveyer C are given numerals in the range of 0 and 99, those for the stacking/unstacking manipulators are given numerals in the range of 100 and 199, those for the reversing manipulator are given 200 to 299, and so on.

Figure 4:
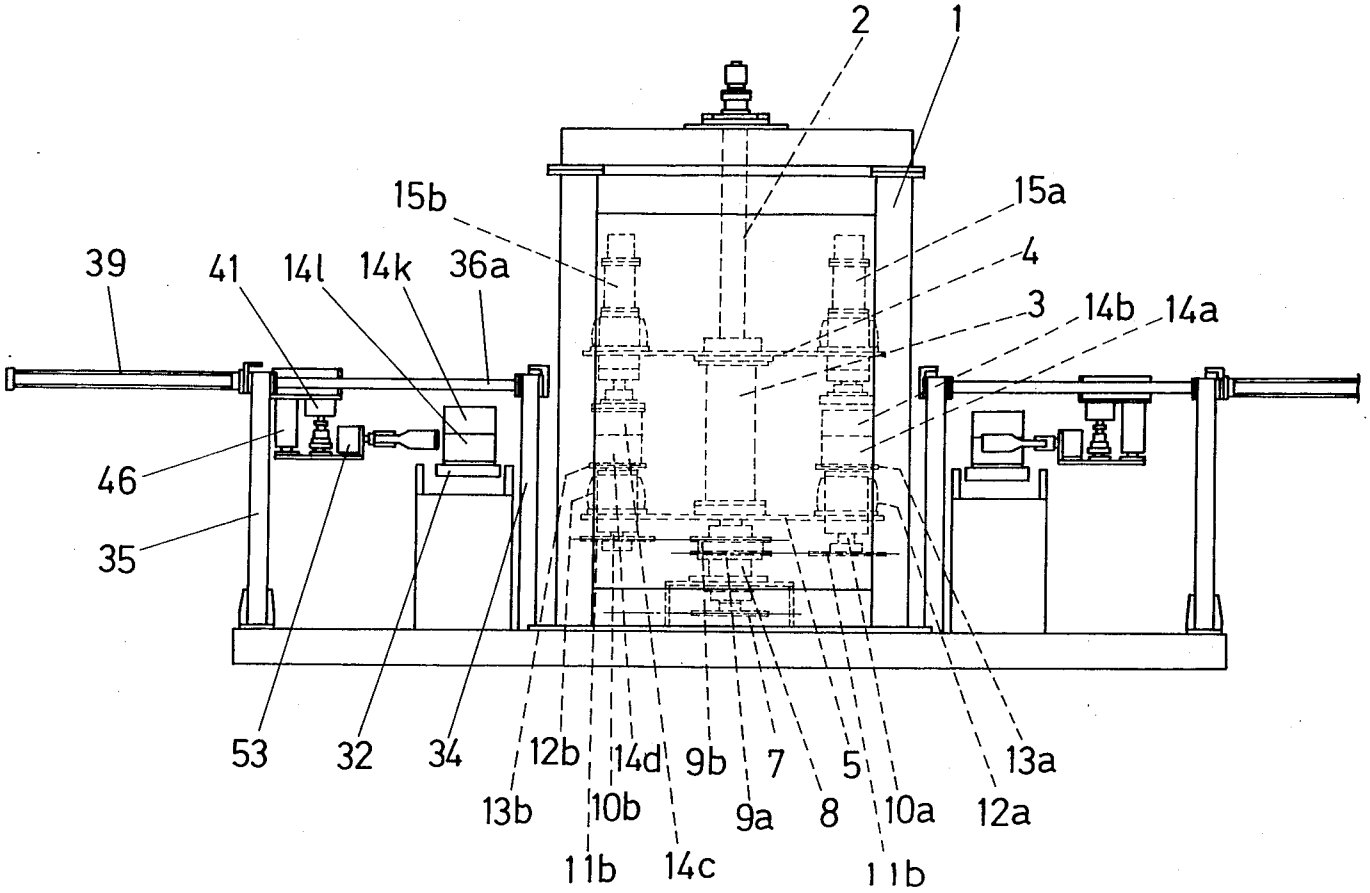
FIG. 4 is a front view of one of the individual work finishing units, showing its general construction.
Figure 5:
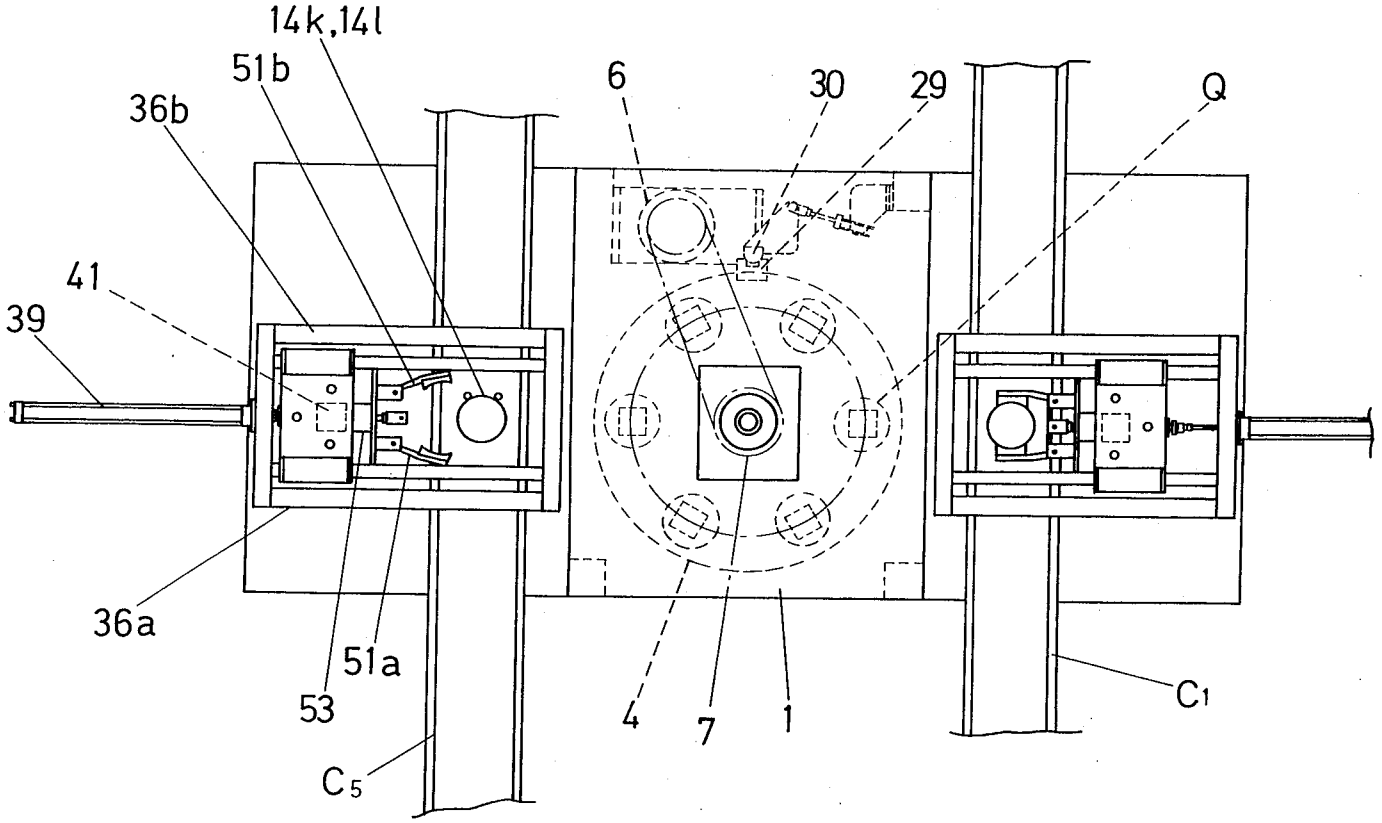
FIG. 5 is a plan view of the unit in FIG. 4.

FIGS. 4 and 5 illustrate the general construction of one of the work finishing units configured in the system. All of the remaining units have the similar construction, and the following description also applies to those remaining units. The unit is placed inside a framework 1, and is rotatably supported by a central spindle 2 which extends vertically across the framework 1. The central spindle 2 has an outer shaft 3 on the lower half thereof, which can rotate with the central spindle 2. The outer shaft 3 has an upper turret 4 and a lower turret 5, which are supported by the outer shaft 3 so that they can rotate with the outer shaft 3. The rotation of the outer shaft 3 is caused by transmitting the rotary motion from a main motor 6 to a main pulley 7. Above the main pulley 7, a chain wheel box 8 is rigidly fixed to the framework 1 and supports the bottom end of the central spindle 2. The chain wheel box 8 carries chain wheels 9*a*, 9*b*. The maximum number of chain wheels that can be provided may correspond to the number of shafts that support the barrel containers, which will be described later. In this example, two chain wheels are used for those barrel shafts which are six, as shown. Therefore, each chain wheel engages three shafts for driving the barrel containers for rotation. One unit may contain any number of barrel shafts, and the even number of barrel shafts will be useful in handling the barrel containers, as the loading and unloading positions for the barrel containers are aligned diametrically, as shown in FIG. 4. Normally, an even number of barrel shafts should be used. Sets of barrel containers for one unit (the number of barrel shafts) are represented by S. Barrel shafts, designated by 10*a*, 10*b*, 10*c*, etc., are supported by the corresponding bearings mounted on the lower turret 5 so that they can rotate axially with regard to the lower turret 5. Driving power for those barrel shafts are supplied by chain wheels 11*a*, 11*b*, 11*c*, etc. and chain wheels 9*a*, 9*b* which are linked by chains. The chain wheels 11*a*, 11*b*, 11*c*, etc. are connected to the lower ends of the barrel shafts 10*a*, 10*b*, 10*c*, etc. that extend downwardly through the lower turret 5. The gear ratio for those two kinds of chain wheels defines the ratio of the number of the orbital revolutions to the number of axial rotations of the barrel container. It is assumed, for example, that the gear teeth p for the chain wheels 9*a* and 9*b* and the gear teeth q for the chain wheels 11*a*, etc. are given, the number of the axial rotations for the barrel shafts 10*a*, etc. may be determined by $-p/q$. That is, the barrel shaft can have the number of rotations equal to $-p/q$ during one complete rotation of the central spindle 2. This value defines the ratio of the number of axial rotations to the number of orbital revolutions for aa given barrel shaft, which is usually referred to as n/N. The ratio n/N may have a wide range of values within certain limits, and in most cases, $n/N=-1$ meets the gear ratio requirements for both chain wheels.

When the finishing operation in completed for a given barrel container, and when that barrel container is to be stopped in position, the main motor is switched to its slow speed. A frequency converter, which is per se known and is usually referred to as an inverter or frequency inverter, is provided for this purpose (not shown). This allows the power supply frequency to the main motor be varied, depending upon the high or low speed requirements for the main motor. The barrel container is configured to permit mounting or demounting on the appropriate work finishing unit. In this embodiment, a stack construction that includes two barrel containers one over the other is shown, but a single barrel container may be used or multiply-stacked barrel containers may be used. A manipulator which loads a single or multiply-stacked containers onto the unit or unloads the same from the unit is provided outside the unit. One manipulator that handles a barrel container to be loaded, or loader, is on one side of the unit, and the other manipulator that handles a barrel container to be unloaded, or unloader, is on the opposite side of the unit. Although those manipulators provide the different functions, but may have the similar construction, which will be described later. The abrasive media that can be used for the purpose of the present invention may include either the wet-type or dry-type ones. For the wet-type abrasing media, they contain a mixture of abrasives and compound solution. This type of media may perform well for the cutting, deburring, and radiusing. When they are used, however, automatic processing of the liquid portion of the media is required. The dry-type of media may contain granular organic substances (such as chestnut shells, cone cores, etc. in their milled forms) or granular plastics as well as abrasives, oils, and other additives. This type of media may meet the work surface polishing needs. As it can be used in its dry form, it can be processed easily. In this respect, the dry media may be used in favor of the wet media.

Figure 6:
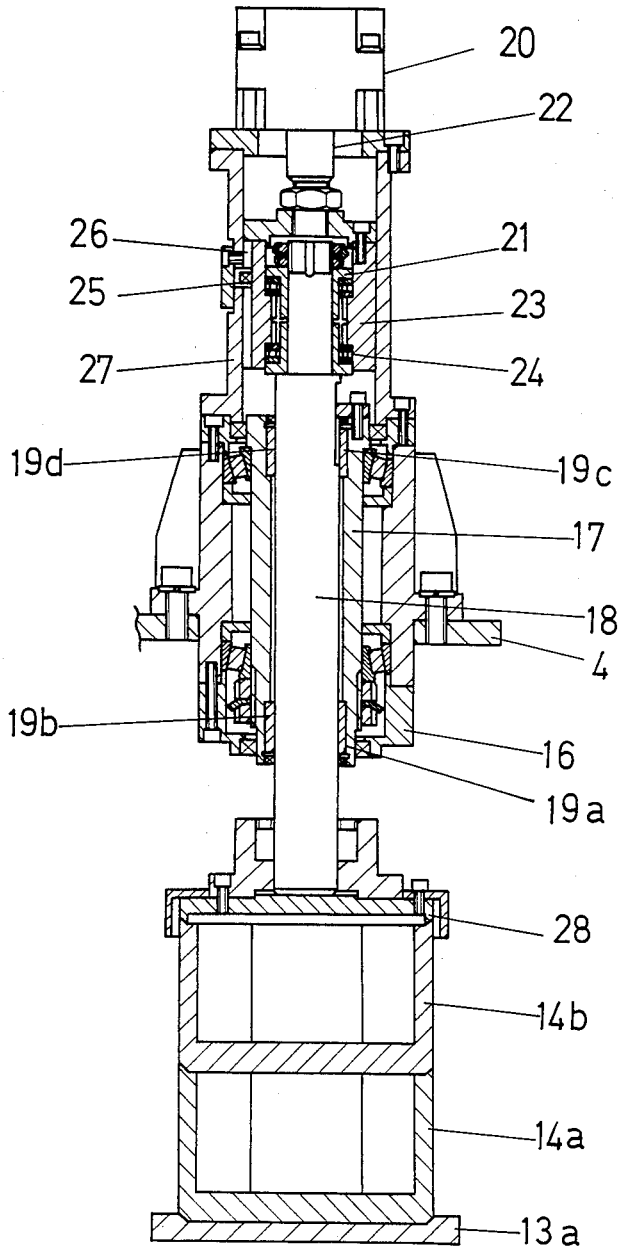
FIG. 6 is a sectional view showing in detail how a barrel container is to be tightened to the corresponding unit.

The construction of the drive mechanism for the barrel container is shown in FIG. 4, in which the shafts 10a, 10b, 10c, etc. for supporting the respective barrel containers are journalled through bearings 12a, 12b, 12c, etc. mounted on the lower turret 5. Each of the barrel shafts 10a, etc. has a barrel container receiving plate 13a, 13b, 13c, etc. at the top end thereof. The barrel containers 14a, 14b, 14c, 14d, 14e, 14f, etc. rest on their corresponding receiving plates 13a, etc. In this embodiment, two barrel containers are stacked one over the other, which are placed on the corresponding receiving plate. A single barrel container or three- or more-stacked containers may rest on it. A clamp 15a, 15b, 15c, etc is provided immediately above each of the barrel containers, and is secured to the upper turret 4. This clamp holds the barrel container during the finishing operation. As the requirements for the clamp, it should be able to rotate with the corresponding barrel container 14a, 14b, 14c, etc., each of the barrel containers should be kept hermetic during the finishing operation, the clamp should be able to travel up so that the barrel container can be untightened from the clamp and released from its hermetic state at the end of the finishing operation, the fluid-operated cylinder that controls the travel up/down of the clamp should be prevented from its rotation, and the fluid power should be supplied to the power-driven parts while the barrel container is having the orbital and axial rotations. The clamp and its associated parts are described below, the details of which are shown in FIG. 6. The clamp consists of a hollow shaft 17 which is rotatably journalled within a lower bearing 16 secured to the upper turret 4, and a center shaft 18 which is shown, for example. The hollow shaft 17 has the center shaft 18 extending through it, which is coupled with the hollow shaft 17 by means of key 19a, 19b, 19c, and 19d so that it can slide through the shaft 17 and rotate therewith. The center shaft 18 (rotational portion) is coupled with a fluid-operated cylinder 20 (non-rotational portion) which controls the travel up or down of the center shaft 18, as shown. That is, the center shaft 18 has a bushing 21 at the top end thereof, and the fluid-operated cylinder 20 has a flange 23 secured to the forward end of its piston rod 22. Thus, the center shaft 18 is supported rotatably and travelably by a bearing 24 that is disposed between the bushing 21 and the flange 23 which travels up and down with the piston rod 22.

The clamp can hold the barrel container tightly or release it by causing the center shaft 18 to travel up or down. The contents might escape from the container if there should be any drop in the applied pressure supply from the cylinder 20 when the barrel container is tightened. In order to avoid such situation, the cylinder 20 uses the hydraulic fluid, rather than the pneumatic air. Then, the supply of the fluid pressure is stopped after applying the required pressure. In this way, the barrel container can be kept hermetic even if there should occur power failure that may cause the source pressure to drop. The conversion from the pneumatic air to hydraulic fluid supply for the cylinder 20 may take place by using the commercially available "HYDRO UNIT".

The flange 23 has an anti-rotation stopper 25 which is affixed to the upper bearing 27, and also has a longitudinal groove 26 which the forward end of the piston rod 22 engages. Thus, the piston rod 22 is prevented from being rotated. A dish-like plate 28 for holding the barrel container is secured to the bottom end of the center shaft 18, and holds the barrel container when the piston rod 22 is lowered. In order to stop the upper and lower turrets 4 and 5 in position, either of the turrets has a number of plates 29, which are provided at those specific positions around the periphery of the turret which determine where the turret is to be stopped. Therefore, the number of the plates 29 corresponds to the number of the barrel shafts, as shown in FIG. 5. Each of the plates 29 is provided with a notch on the side where a positioning pin 30 is provided opposite it. Thus, the turret is stopped when the positioning pin 30 engages the notch.

Figure 7:
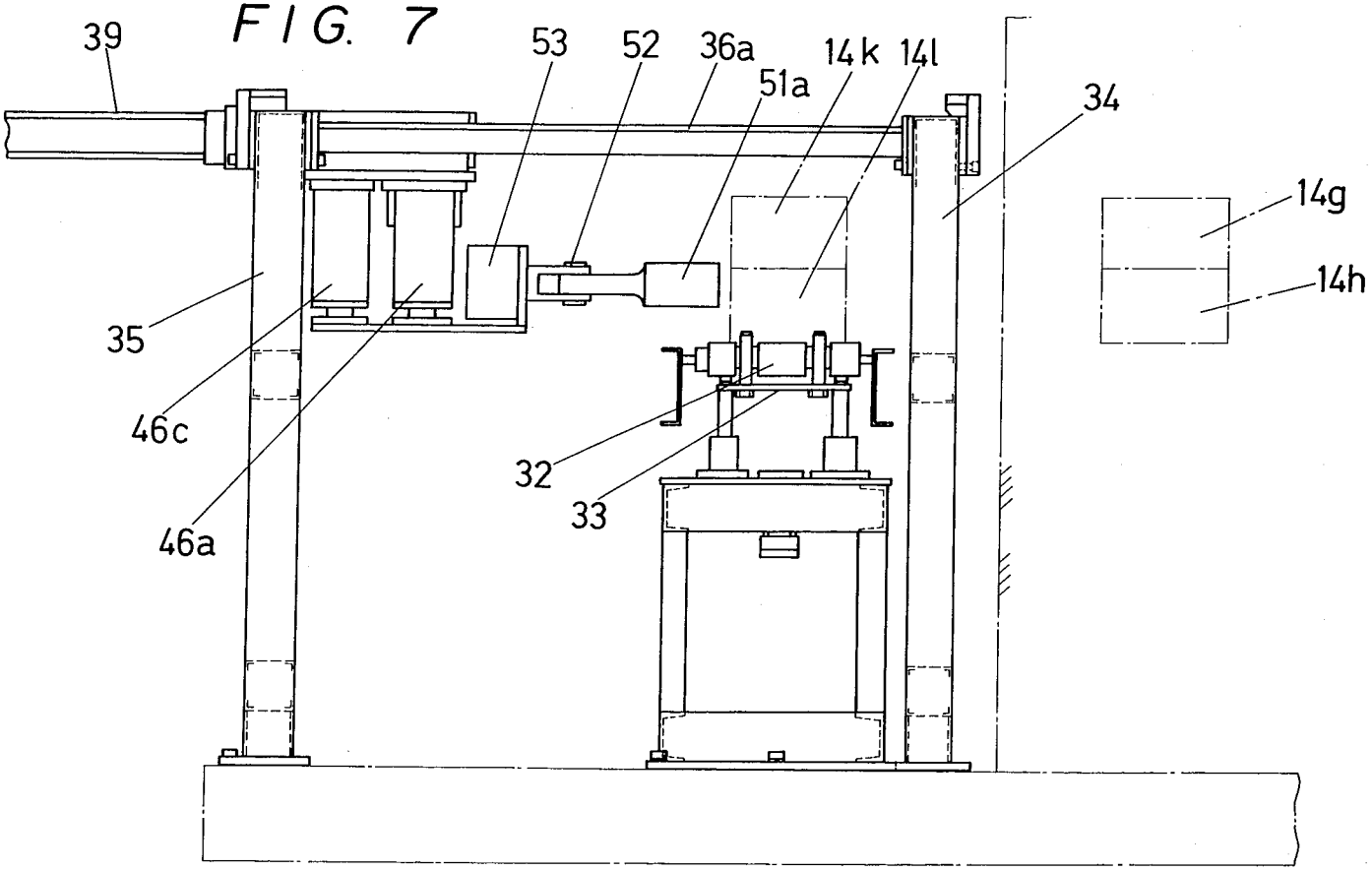
FIG. 7 is a front view illustrating the relative positions between the manipulators and a barrel containers.

Now, a loading/unloading manipulator is described in detail. This manipulator includes a loader and an unloader, which are disposed on the opposite sides of a work finishing unit. The loader handles a single or multiply-stacked barrel containers that contain works to be surface-finished. Those new works are placed into a barrel container by means of a work feeder that is specifically provided for arranging works in the condition for being placed into the container. For the multiply-stacked barrel containers, which are shown as the two-stacked containers in this example, following this, two barrel containers are placed one over the other by means of a stacking device. Then, the barrel container (or stacked containers) is placed onto a loader conveyer C5, which transports it toward the loading manipulator. When it arrives in front of the loading manipulator, it is stopped in position by means of a stopper 33 which is provided on the loader conveyer C5 as shown in FIG. 7. The unloading manipulator handles the barrel container containing the works that have been surfaced-finished. It holds the barrel container away from the work finishing unit onto a unloader conveyer C1, which transports the container toward a barrel reverser located outside the system, where the barrel container is turned over. The contents are then removed from the barrel container onto a mass separator where the works and abrasive media are separated. The relative positions between the above-described manipulations and work finishing unit are shown in FIGS. 4 and 5, and the details of the manipulator are given in FIGS. 7 and 8. In those figures, the barrel containers located within the work finishing unit are identified by 14g, 14h, and the barrel containers located on the loader or unloader conveyer are identified by 14k, 14l.

Figure 8:
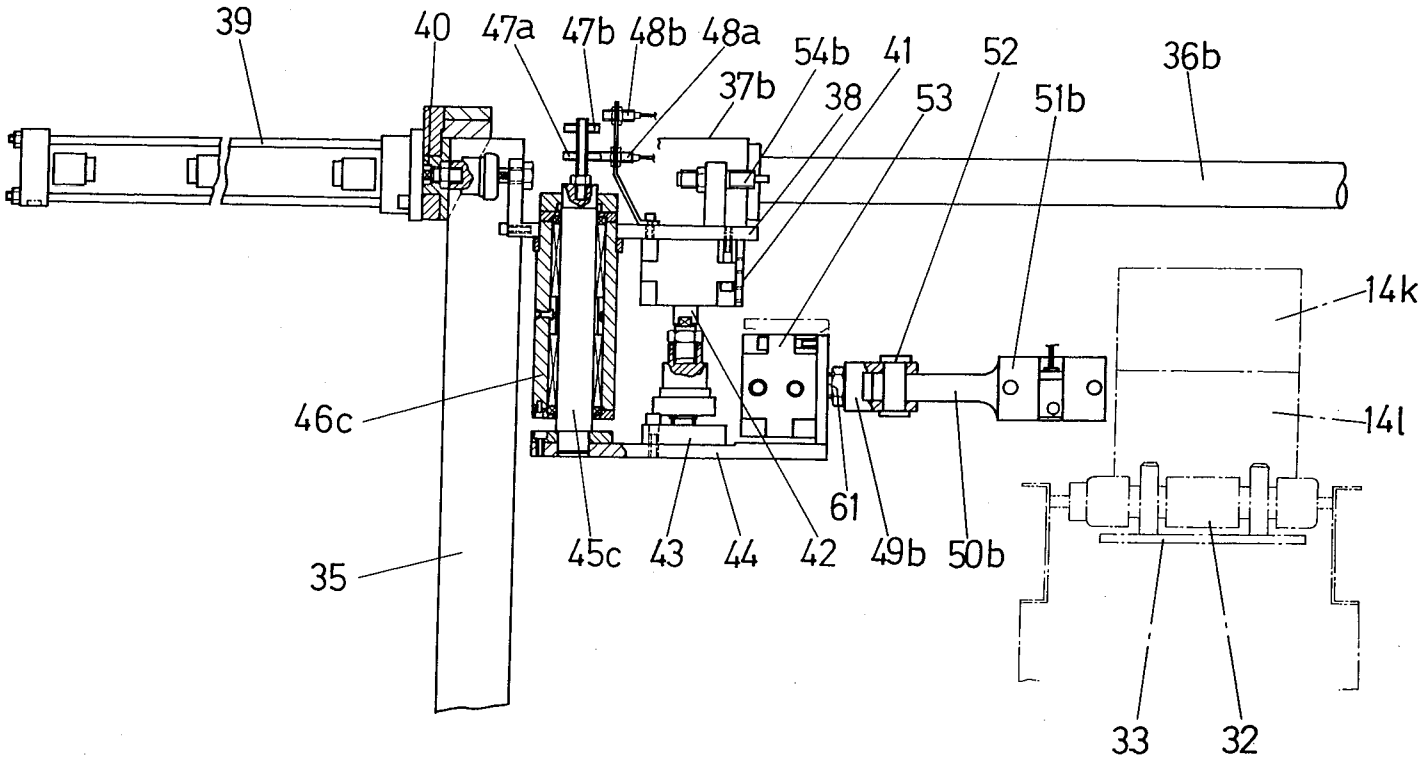
FIG. 8 is a detailed sectional view showing part of one of the manipulators.
Figure 9:
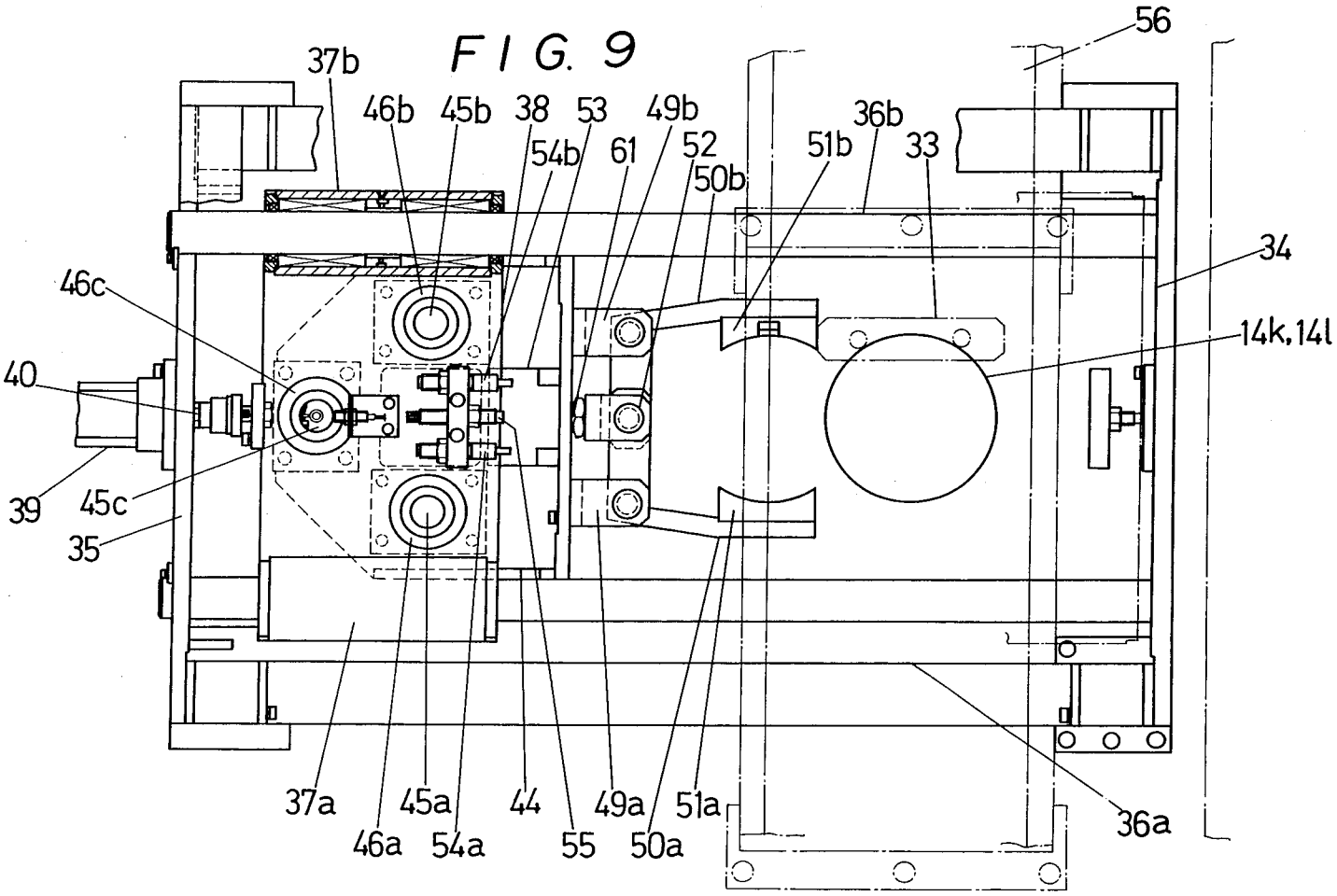
FIG. 9 is a plan view of a manipulator.

The loading manipulator handles the barrel containers to move them from the positions 14g, 14h to the positions 14k, 14l, while the unloading one moves them from 14k, 14l to 14g, 14h. Both have the similar construction and function, and therefore the following description is only made of the loading one. The barrel container traveling on the rollers 32 on the loader conveyer C5 has already contained unprocessed works and abrasive media. When the barrel container reaches the position where it should be stopped, it is arrested by the stopper 33 which is then protruded. Then, the barrel container is handled by the loading manipulator, which transfers it to the work finishing unit. The detailed construction of the manipulator is given in FIGS. 8 and 9. As shown, the loading manipulator is located in front of the work finishing unit, and is supported by its supporting frames 34, 35 on the opposite sides of the loader conveyer C5. Those supporting frames 34, 35 are bridged by two parallel guide shafts 36a, 36b across the frames. Each of the guide shafts 36*a*, 36*b* carries a slider 37*a*, 37*b* which is fitted around the corresponding guide shaft slidably along its length. The sliders 37*a* and 37*b* are mounted on a slider base 38. On its one side (the left-hand side in FIG. 9), the base 38 is connected with a piston rod 40 of a fluid-operated cylinder 39. Thus, as the piston inside the cylinder 39 moves forward or backward, the base 38 also travels forward or backward together with the sliders 37*a* and 37*b* along the guide shafts 36*a* and 36*b*. A fluid-operated cylinder 41 is mounted beneath the slider base 38 (FIG. 8). The fluid-operated cylinder 41 has a piston rod 42 extending therefrom, to the forward end of which a floating joint 43 is affixed. A base 44 on which the loading manipulator is mounted is connected by way of the floating joint 43 to the cylinder 41. The manipulator base 44 has flanges extending therefrom, to which a bell-crank arms equipped with manipulator pawls 50*a*, 50*b* (FIG. 9) is mounted, so that the manipulator pawls 50*a*, 50*b* can open and close. Each of the manipulator pawls 50*a* and 50*b* is lined with a shock absorber 51*a*, 51*b*, which is made of rubber or synthetic resin material, on the sides thereof facing each other. Those shock absorbers 51*a* and 51*b* protect the barrel container 14*k*, 14*l* against any possible injury when it is held by the pawls 50*a* and 50*b*. The manipulator pawls 50*a* and 50*b* are coupled together by means of a center pivot pin 52 which supports them pivotally. One of the bell-crank arms is connected with a piston rod 61 from a fluid-operated cylinder 53. Thus, the forward or backward movement of the piston rod 61 that is controlled by the fluid-operated cylinder 53 is followed by the opening or closing motion of the manipulator pawls 50*a* and 50*b*. The manipulator base 44 travels up or down along a plurality of guides (which are shown as three guides 45*a*, 45*b*, 45*c*). Those guides 45*a*, 45*b*, and 45*c* are journalled through bearings 46*a*, 46*b*, and 46*c*, respectively, which are affixed to the slider base 38. Shock absorbers 54*a*, 54*b*, which are per se known, are provided above the slider base 38. As the manipulator pawls are advancing toward the work finishing unit, and are striking against it, the impact that may occur can be absorbed by the shock absorbers 54*a* and 54*b*. The shock absorbers contain limit switches, which respond by delivering signals when the manipulator pawls 50*a* and 50*b* are advancing to the position for holding the barrel containers 14*k*, 14*l*. When one work finishing unit accommodates an even number of barrel containers which are arranged at equal angular positions, as described earlier, the loading and unloading manipulators may be aligned diametrically opposite each other, and the loader and unloader conveyers may be disposed across that diametrical line. In this case, the barrel container may be transferred to or away from the work finishing unit by means of the manipulators, in the same direction as the manipulators travel in the direct path. Thus, the manipulators can advantageously have their simplified construction.

The constructional features of the present invention have been described, and now the functional or operational features are described. All of the functions provided by the machine according to the present invention are performed automatically under the control of the programmable sequence controller which is known by itself, but some of them may be manual.

The following description is provided, assuming that one cycle of the work finishing operation, whose duration is previously set by a timer, is completed. Then, as the time period preset by the timer elapses, the timer causes an electric current to flow through the frequency inverter to the main motor, and the main motor is switched to its slow speed. The positioning pin 30 is moved forward, and engages the notch formed on the stopper 29, thus stopping the turrets in the position. When the turrets are stopped, the micro switch, which is located on either the upper turret 4 or lower turret 5 and is not shown, responds by sending a signal to the main controller A. In response to this signal, the main controller A causes a pressurized fluid to be introduced into the piston rod side 22 of the hydraulically-operated cylinder 20 which is located on the position where a particular barrel container, which in this case is shown as the stacked containers 14*a* and 14*b*, is to be removed (as indicated by Q in FIG. 5). Thus, the dish-like plate 28 which holds the stacked containers as shown in FIG. 6 is moved up, and the stacked containers 14*a* and 14*b* are released from the plate 28. At the same time as the above procedure, the manipulator pawls 50*a* and 50*b* on the unloader are advanced. At this time, it is assumed that the manipulator pawls 50*a* and 50*b* are open, and are placed in their lower position under the action of the cylinder 41. Then, a pressurized fluid is drawn into the piston side of the fluid-operated cylinder 39 (FIG. 9), causing the manipulator pawls 50*a* and 50*b* to advance. At the end of their travel course, the impact that may occur between the pawls and stacked containers will be reduced by the shock absorbers 54*a* and 54*b*. When the manipulator pawls have completely advanced, this is detected by the micro switch 55 located between the shock absorbers 54*a* and 54*b*. In response to a signal from the micro switch 55, a pressurized fluid is drawn into the pistion rod side of the fluid-operated cylinder 53, causing the manipulator pawls 50*a* and 50*b* to close. Thus, the barrel containers are held by the pawls. Then, the manipulator pawls 50*a* and 50*b* holding the barrel containers are moved up under the action of the cylinder 41. When the pawls have reached their upper position, a pressurized fluid is introduced into the piston rod side 40 of the cylinder 39, which transfers the stacked containers held by the manipulator pawls to the position where the unloader conveyer C1 is located. In this position, the manipulator pawls 50*a* and 50*b* are again lowered, from which the stacked containers are released and are placed onto the unloader conveyer C1. The unloader conveyer C1 carries the stacked containers toward the next following stage (such as where the barrel containers are to be reversed). Then, the turrets 4 and 5 are rotated by 360 degrees/S (where S represents the number of barrel shafts). The next succeeding stacked barrel containers are then removed from the work finishing unit in the same manner as described for the preceding stacked barrel containers. The next time the two preceding stacked barrel containers have been removed, the third succeeding stacked containers which contain the surface-finished works appear on the unloader side, while the disk-like plate carrying no barrel containers thereon appear on the loader side. The third stacked containers are removed as described above, and a new set of stacked barrel containers which contain works to be processed is then transferred to the loading manipulator, which loads it to the appropriate work finishing unit. As the loading occurs reversely to the sequence for the unloading, and it is clear from the foregoing description, the description for the loading is omitted. When all sets of the stacked containers have been unloaded for the times of S, there are no containers that contain the surface-finished works. Then, for the subsequent times equal to S/2, the succeeding sets of stacked containers that contain works to be processed are to be loaded. After the p sets of such containers have been loaded, the main motor is switched to its high-speed mode, and the work surface finishing operation is resumed for those containers. All subsequent operations occur in the same manner as described above.

In summary, in order to make all machine operations automaticably, the machine construction includes the individual barrel containers (which may be stacked as described) which are built to be mounted or demounted on the individual work finishing units, the loader and unloader conveyers on the loading and unloading sides of the work finishing units, and the loading and unloading manipulators on the corresponding sides that handle the barrel containers to transfer them from the loader conveyer to the work finishing unit or to transfer them from the work finishing unit to the unloader conveyer. Thus, replacing the contents for the barrel containers can be performed independently of all the automatic machine operations and thus without stopping the machine operations. This also saves the waste time required for replacing the contents.

Figure 10:
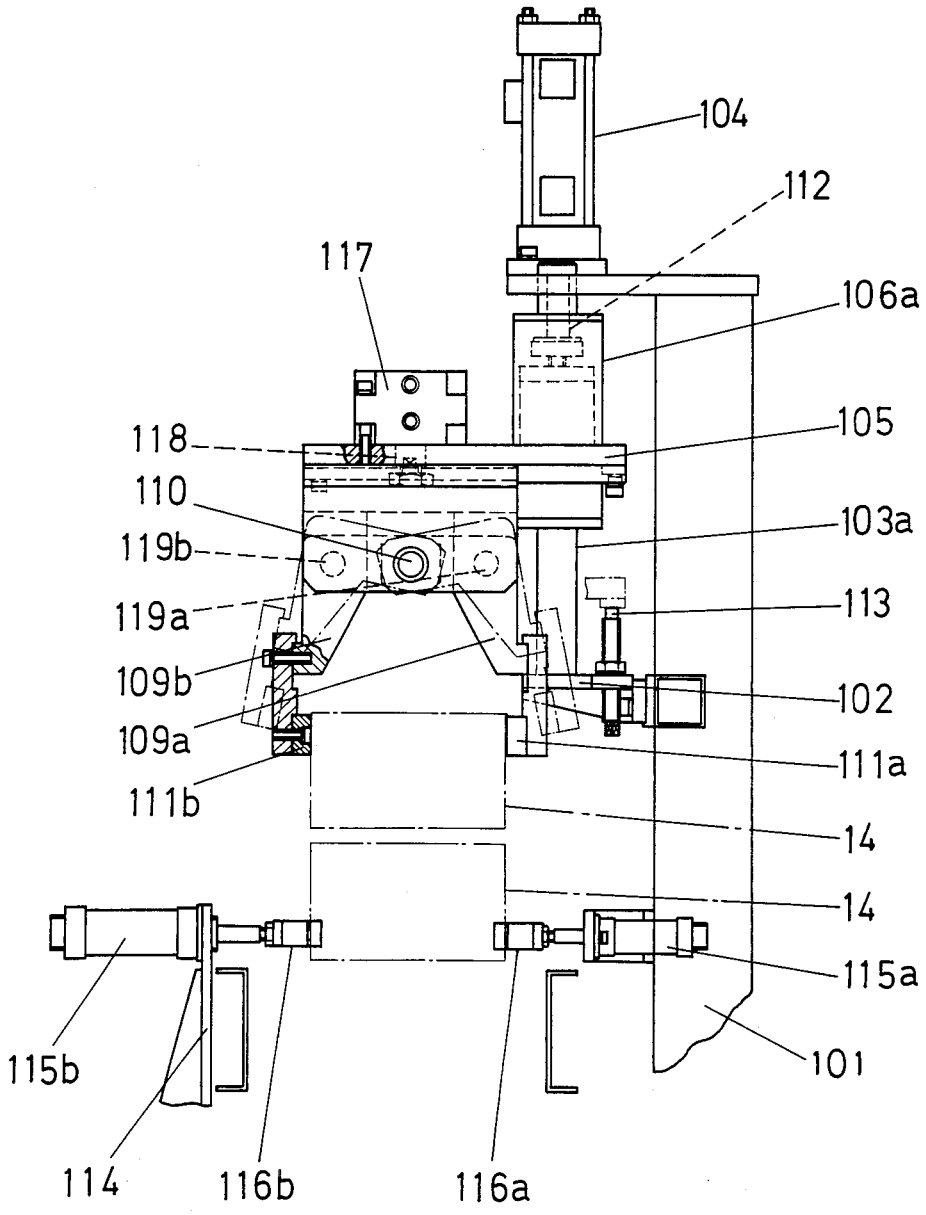
FIG. 10 is a front view of the manipulators for loading/unloading a barrel container and for stacking multiple containers.
Figure 11:
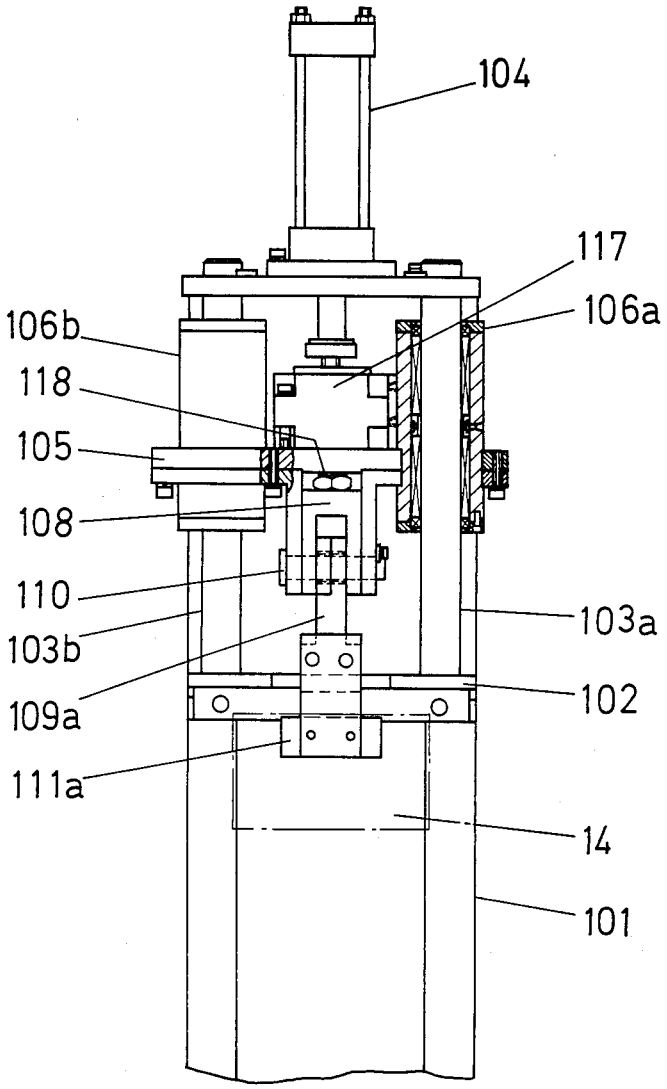
FIG. 11 is a side elevation of the manipulators in FIG. 10.

The barrel containers that have been removed from the work finishing unit are then transferred on the unloader conveyer C1 to the unstacking manipulator, which is specifically provided for unstacking the stacked-barrel containers one by one. This manipulator is not required for the single barrel containers. The stacking manipulator P and unstacking manipulator D have the identical construction, which is shown in FIGS. 10 and 11. The following description is provided to illustrate the manipulator construction that handles the two-stacked barrel containers, for example. As shown in those figures, it includes a support arm 101 extending vertically from the ground, on which the main operational parts are supported. A support plate 102 is provided as an integral part of the support arm 101, to which support posts 103*a* and 103*b* are affixed. A fluid-operated cylinder 104 is mounted atop the support arm 101, and has a piston rod 112, to the forward end of which a manipulator base 105 is secured. The fluid-operated cylinder 104 is of the type that can have two stop positions during it course. The manipulator base 105 has bearings 106*a* and 106*b* that slide through the support posts 103*a* and 103*b*. With the sliding movement of the bearings 106*a* and 106*b*, the manipulator can travel up and down along the posts 103*a* and 103*b*. A fluid-operated cylinder 117 is also mounted above the manipulator base 105, and has a piston rod 118, to the bottom end of which a forked arm 108 is affixed. Each arm of the forked arm 108 has an elongated aperture, which engages a pin 119*a*, 119*b* provided on a jaw plate 109*a*, 109*b*. Each of the faw plates 109*a* and 109*b* has a bell-crank shape, and is pivotally supported by a pivot pin 110. Each jaw plate carries a holder 111*a*, 111*b* at its forward end, the holder having a curved surface on the side facing the barrel container 14. The curved surfaces for the holders have the shape that matches the cylindrical body shape of the barrel container, and the holders hold the barrel container 14 from its opposite sides when the piston rod 118 of the fluid-operated cylinder 117 is in its upper position. The support plate 102 has a stopper 113, which arrests the manipulator plate 105 in its lowest position. An arrester is also provided across the roller conveyer C1 for stopping the barrel container in position. The arrester includes a set of fluid-operated cylinders 115*a* and 115*b* on the opposite sides of the roller conveyer C1, each of the cylinders being supported by a vertical post 114 and being disposed horizontally for engaging the lower portion of the barrel container. More specifically, the cylinder has a piston rod, to which a positioning lever 116*a*, 116*b* is affixed. The positioning lever has a curved surface on the side facing the barrel container, the curved surface having the shape matching the cylindrical body shape of the barrel container 14. When the piston rod is fully extended from its cylinder, the levers 116*a* and 116*b* hold the barrel container from its opposite sides. Thus, the container is arrested by the levers in the correct position.

According to the stacking/unstacking manipulator construction that has been described, its operation is now described. The two-stacked containers 14 are carried on the roller conveyer C1 until they reach the unstacking manipulator D, where they are arrested and stopped. This is detected by a limit switch LS1 (where LS refers to a limit switch, which hereinafter will be simply mentioned by LSx where x is a digit), which delivers a signal to the main controller A which in turn issues an instruction or command for causing a pressurized fluid to be introduced into the piston sides of the fluid-operated cylinders 115*a* and 115*b*. Thus, the piston rods advance, and the barrel containers are held by the levers 116*a* and 116*b*. As the levers have the curved surfaces matching the cylindrical barrel body, they can fit it when they are moved forward by their respective piston rods. Thus, the barrel container is arrested in the correct position. This is also detected by LS1, which delivers a signal to the main controller A. In response, the main controller issues a command which causes a pressure fluid to be drawn into the piston side of the fluid-operated cylinder 104. Thus, the piston rod 112 extends downwardly, and the jaw plates 109*a* and 109*b* are also moving down to the lowerst position where the upper barrel portion is to be held. When the jaw plates stop at that position, a pressurized fluid is introduced into the piston rod side of the fluid-operated cylinder 117, the holders 111*a* and 111*b* for the jaw plates 109*a* and 109*b* are holding the upper barrel container. Then, a pressurized fluid is delivered into the piston rod side of the cylinder 104, and the stacked containers with its upper portion held by the holders are moving up. When they are moving up, a pressurized fluid is drawn into the cylinders 115*a* and 115*b*, causing the levers to be moved away from the lower barrel container which is on the roller conveyer C1. Thus, it is released from the levers, and then the conveyer is again run. The lower container advances on the conveyer, leaving the unstacking position behind it. Then, the manipulator holding the upper barrel is moved down, and when it is approaching near the conveyer surface, the upper barrel is released from the manipulator and is placed onto the conveyer C1, which transfers it. Then, the manipulator D is again moved up, and is waiting for the next succeeding stacked barrel containers to come.

The preceding description has been made in particular reference to the unstacking manipulator D which unstacks the two-stacked barrel containers one by one, and applies similarly to the stacking manipulator which is this case stacks single barrel containers one atop another. The sequence for the stacking manipulator includes arresting a first barrel container in its stop position on the roller conveyer, lowering the manipulator, holding the barrel container, releasing it from its held state, moving up the manipulator, running the roller conveyer, arresting a second barrel container and positioning it, lowering the manipulator which holds the second barrel container, releasing it from its held state and the first and second barrel containers, moving up the manipulator, releasing the stacked containers from their held state, and conveying them.

The above description has been made for the two barrel containers that are to be stacked or unstacked, but may apply for three or more barrel containers to be stacked or unstacked.

Each of the single barrel containers that have been unstacked by the manipulator D is reversed by the reversing manipulator E, from which the contents are transferred from the barrel containers onto the mass separator F.

Figure 12:
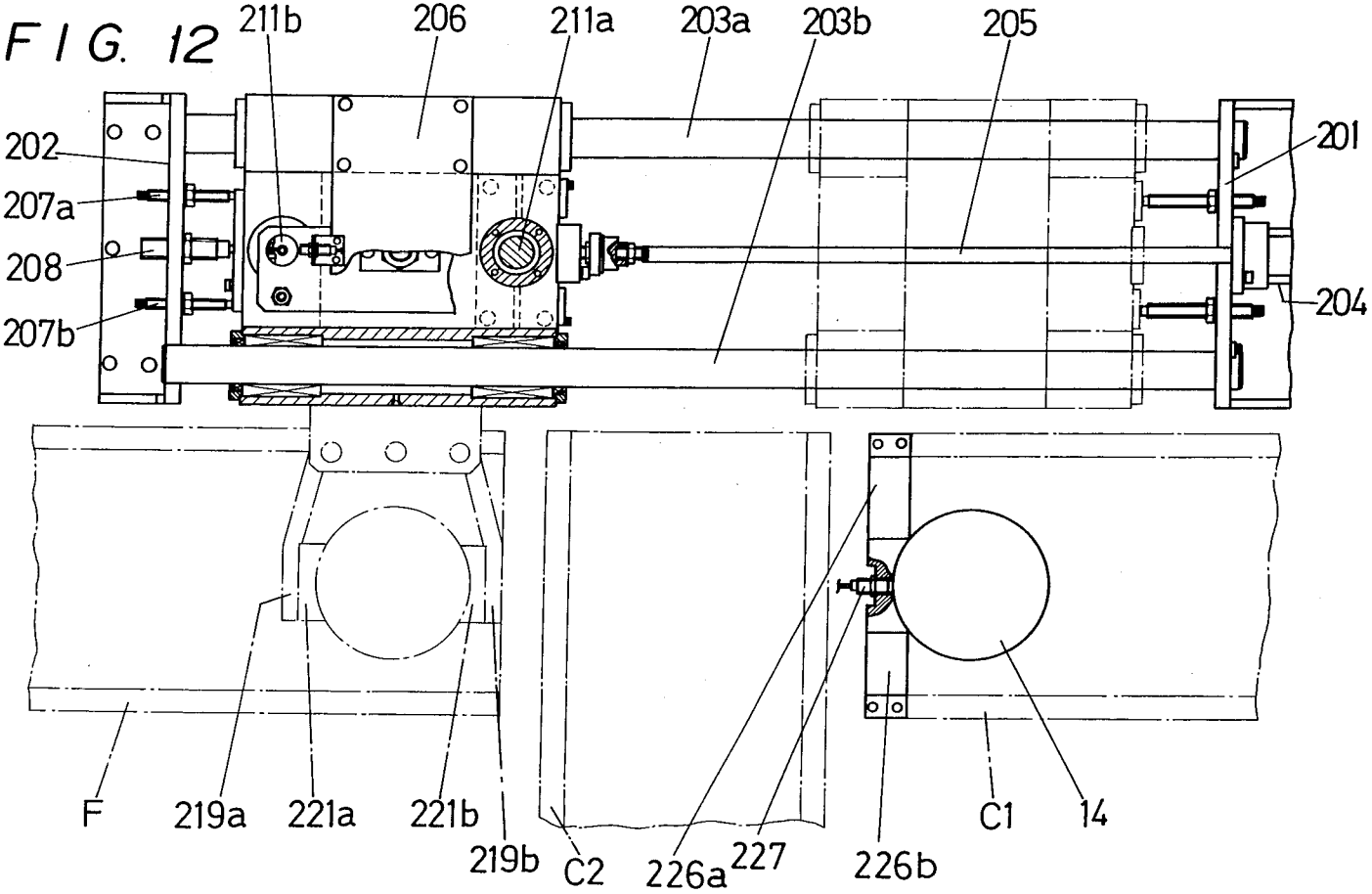
FIG. 12 is a front view of a manipulator that turns over a barrel container.
Figure 13:
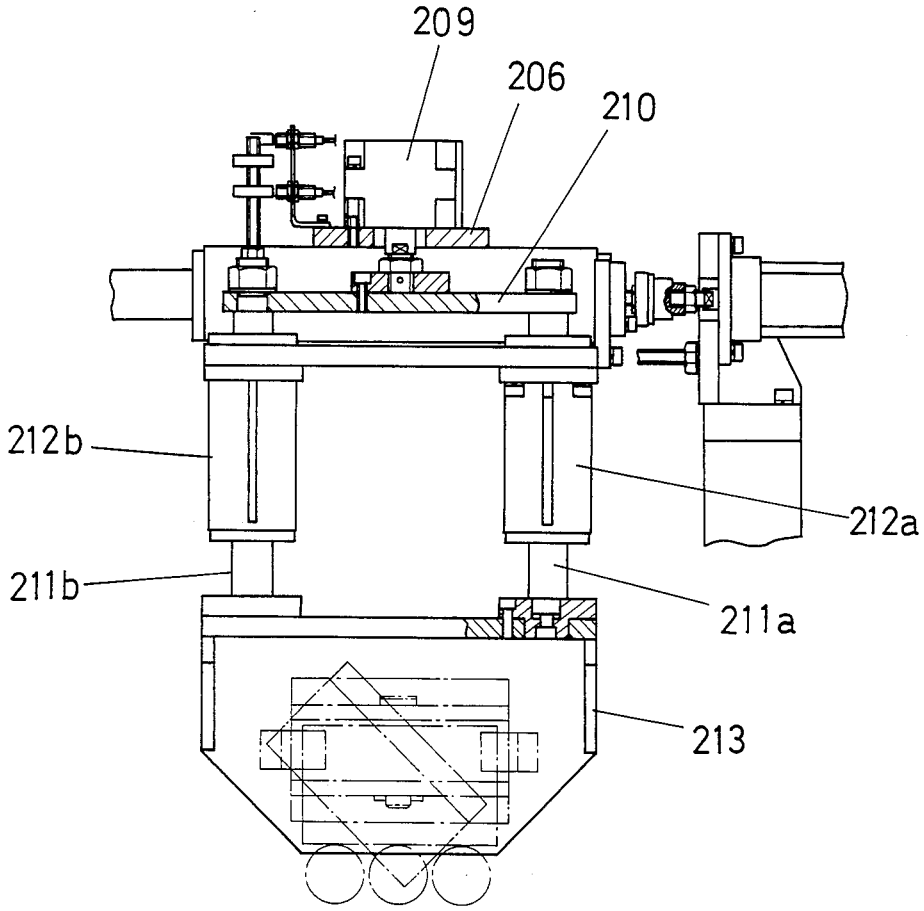
FIG. 13 is a front view of the mechanism that raises or lowers the turn-over manipulator.
Figure 14:
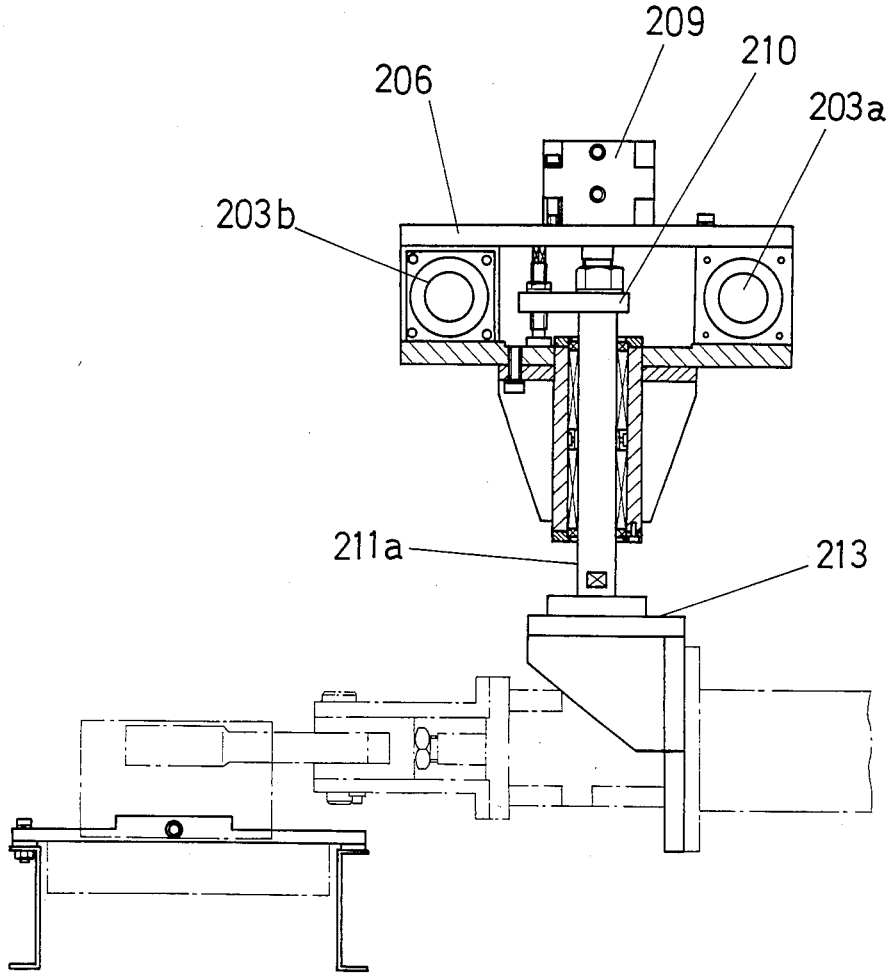
FIG. 14 is a side elevation of the machanism in FIG. 13.
Figure 15:
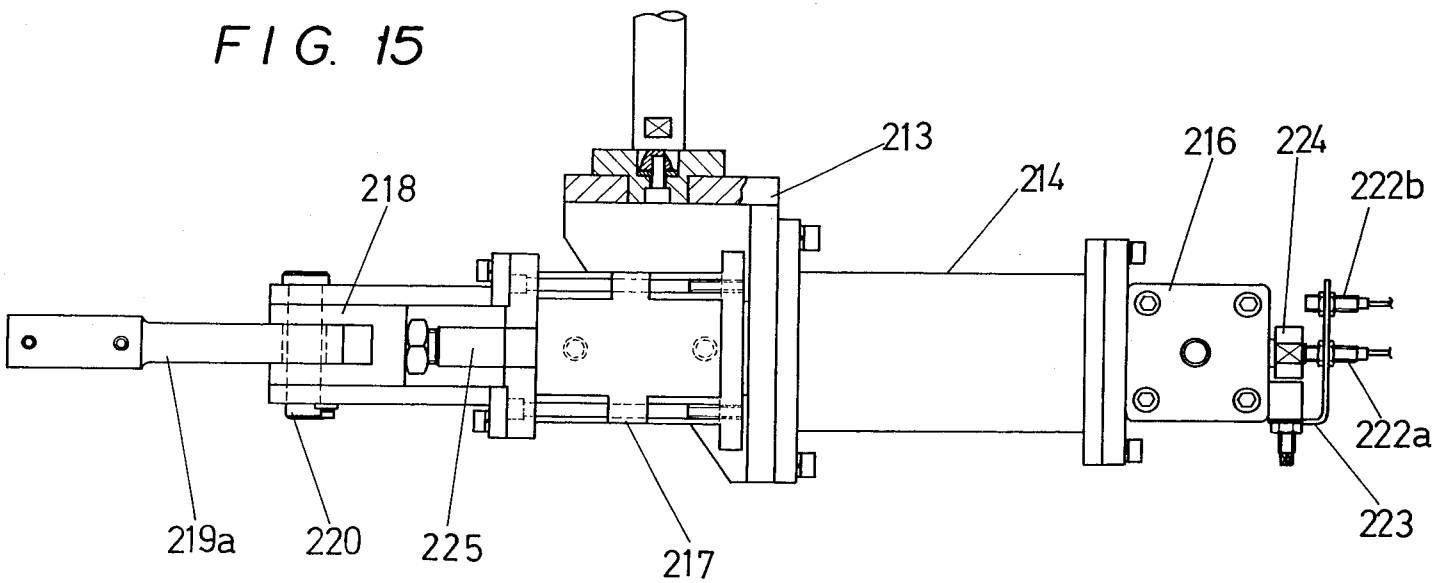
FIG. 15 is a front view of the mechanism for the turn-over manipulator.
Figure 16:
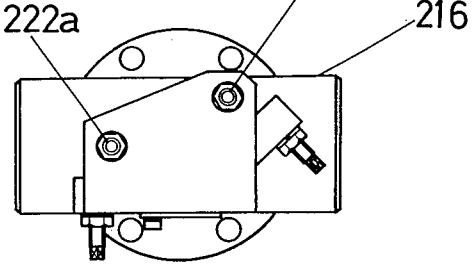
FIG. 16 (*a*) is a side elevation of a rotary actuator, showing its shaft end.
Figure 16:
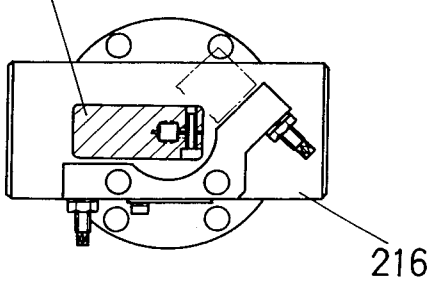
Figure 17:
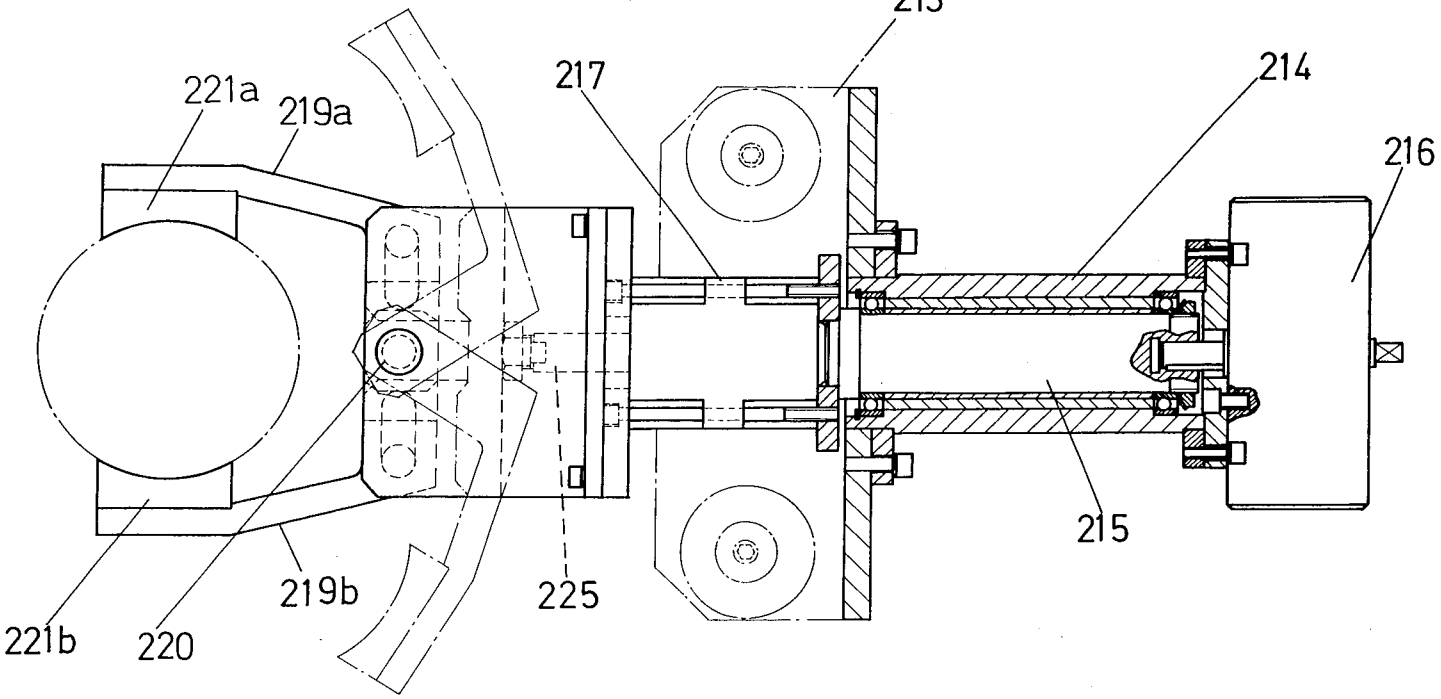
FIG. 17 is a plan view of the mechanism for the turn-over manipulator.

The construction of the reversing manipulator E is illustrated in FIGS. 12 through 17. Its function is described. When a single barrel container 14 which travels on the conveyer C1 reaches the end of C1, it is held by the reversing manipulator E, which transfers it above the mass separator F and turns it over. Thus, the barrel contents are removed onto the mass separator F. Then, the barrel container is again restored to its original posture, and rests on the roller conveyer C2. As shown in FIG. 12, the manipulator E is disposed across the end of the conveyer C1 and the beginning of the conveyer C2, on the opposite sides of which frames 201*a* and 201*b* are provided. The frames 201*a* and 201*b* support two shafts 203*a* and 203*b* extending parallelly between them. The shafts supports the manipulator E slidably along them. The frame 201 carries a fluid-operated cylinder 204 (which is partly shown), whose piston rod 205 extends toward the left and is connected to the front of the manipulator block 206. The manipulator block 206 has bearings each of which supports and slides along the corresponding shaft 203*a* or 203*b*. The frame 202 has stoppers 207*a* and 207*b*, and a shock absorber 208. A device that causes the manipulator to travel up and down is shown in FIGS. 13 and 14. FIG. 13 is a front view of FIG. 12, and FIG. 14 is a side elevation of FIG. 12. A fluid-operated cylinder 209 is mounted above the manipulator 206, and the piston rod from the cylinder 209 carries a plate 210 that travels up and down with the piston rod. The plate 210 has shafts 211*a* and 211*b*, which are journalled through bearings 212*a* and 212*b* mounted beneath the manipulator block 206. The shafts 211*a* and 211*b* have a frame 213 at the bottom ends thereof, to which the manipulator block is mounted. Details on how the manipulator block is mounted to the frame 213 are shown in FIGS. 15 and 17. As shown, A bearing 214 is secured to the frame 213, extending from the vertical part of the frame, and an actuator shaft 215 is journalled rotatably within the bearing 214. The actuator shaft 215 is connected at its one end with the rotor for a rotary actuator 216, and they are immovably coupled by means of such as a key. The actuator shaft 215 is connected at its other end with a fluid-operated cylinder 217. Other parts such as a piston rod 225 from the cylinder 217, and its associated forked-arm assembly including jaw plates 219*a*, 219*b*, pivot pin 220, and holders 221*a*, 221*b* are similar to those for the stacking manipulator. To avoid the duplicate description, therefore, the description of those parts is omitted. The rotary motion of the shaft for the rotary actuator 216 is detected by limit switches 222*a*, 222*b* mounted on the frame 223 for the rotary actuator, which respond to a dog 224 located on the end of the above shaft. This arrangement is illustrated in FIGS. 16-(*a*) and 16-(*b*). FIG. 16-(*a*) shows it as viewed from the side, with the frame removed, and FIG. 16-(*b*) shows the same with the frame.

According to the above-described construction, its operation is now described. When a barrel container 14 reaches the end of the conveyer C1, it is arrested by stoppers 226*a* and 226*b* and is stopped in position. This is detected by micro switch 227, which sends a signal to the main controller A which in turn delivers a command signal. This control signal causes the jaw plates 219*a* and 219*b* to hold the barrel container 14. Then, the fluid-operated cylinder 209 is actuated to cause the barrel container to move up, and the fluid-operated cylinder 204 is actuated to cause it to move above the mass separator F. Then, the barrel container is reversed by rotating the rotary actuator 216, from which the contents are removed onto the mass separator F. After the contents have been removed, the rotary actuator is again rotated, restoring to its upright posture. Then, the fluid-operated cylinder 204 is actuated, moving the barrel container to the conveyer C2. When it is stopped, the fluid-operated cylinder 209 is then actuated, causing the container to move down, and the fluid-operated cylinder 217 is actuated, causing the container to rest on the conveyer C2. Then, the cylinder 209 is actuated to cause the manipulator to move up, and the cylinder 204 is actuated to move the manipulator toward the end of the conveyer C1. At the end of the conveyer C1, the manipulator is stopped. The subsequent operations occur in the same manner as described above.

Figure 19:
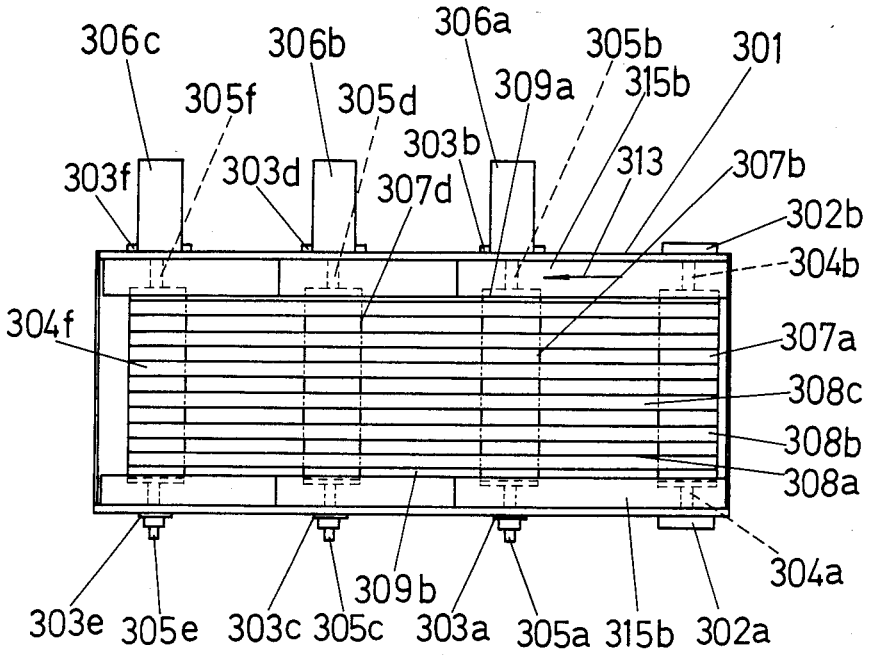
FIG. 19 is a plan view of the mass separator in FIG. 18.
Figure 20:
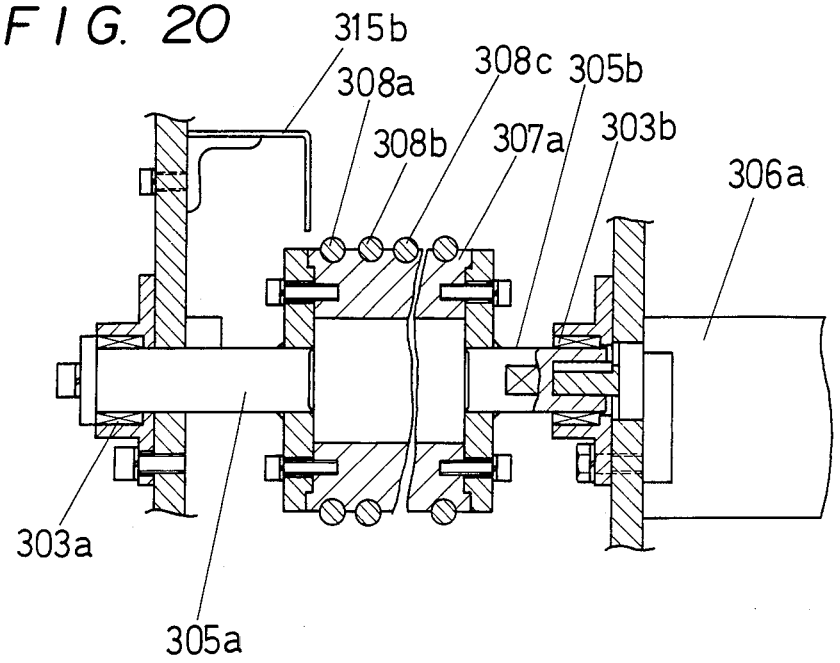
FIG. 20 is an enlarged sectional view of part of one pulley in FIG. 19.

The following is the description of the mass separator F. The mass that contains the finished works and abrasive media is removed from the barrel container onto the mass separator by causing the reversing manipulator E to turn it over. On the mass separator F, the mass is separated into the works and abrasive media. One typical example of the mass separator is illustrated in FIGS. 18, 19, and 20.

Figure 18:
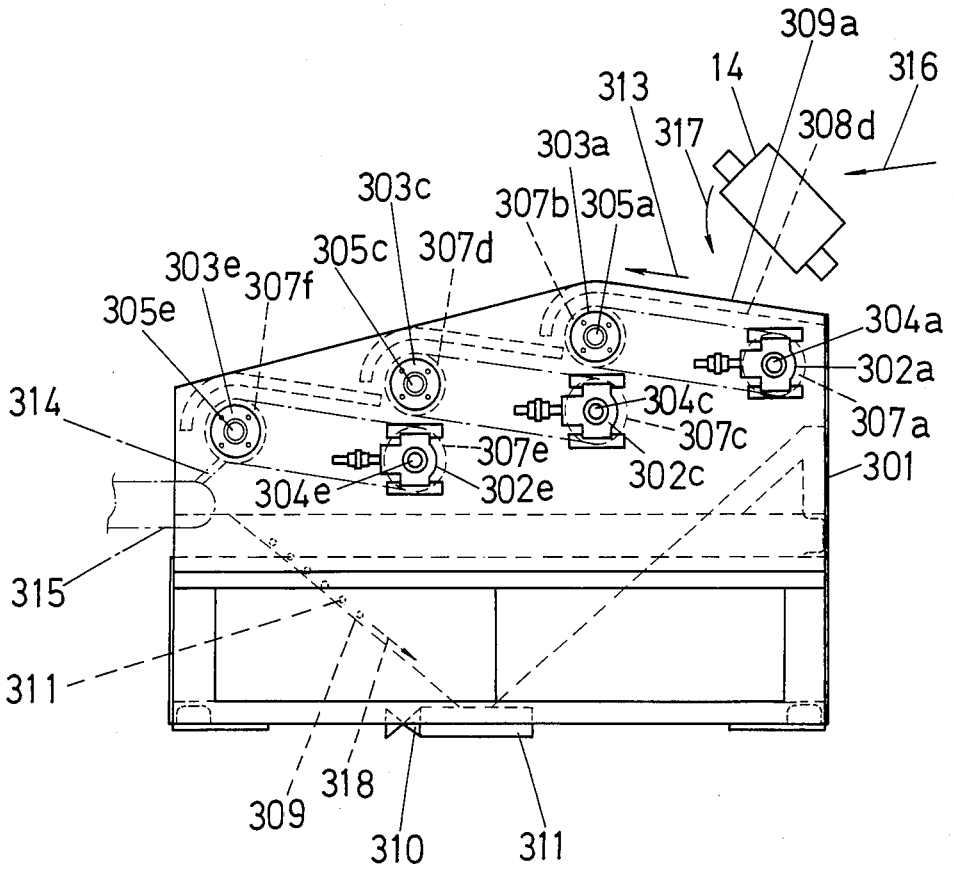
FIG. 18 is a front view of a mass separator.

In FIG. 18, the mass separator casing which is generally designated by 301 contains a plurality of sets of bearings in its upper portion, each set consisting of two bearings which are mounted across the casing. In the example shown, three sets of bearings are arranged longitudinally of the casing, but their number may be varied. Those bearings are indicated by 302*a*, 302*b*, 302*c*, 302*d*, 302*e*, 302*f*, 303*a*, 303*b*, 303*c*, 303*d*, 303*e*, 303*f*, and shafts that are rotatably supported by the corresponding bearings across the casing are indicated by 304*a*, 304*b*, 304*c*, 304*d*, 304*e*, 304*f*, 305*a*, 305*b*, 305*c*, 305*d*, 305*e*, 305*f*. The shafts 305*b*, 305*d* and 305*f* are drive shafts, which are coupled at their one ends with the rotary shafts of motors 306*a*, 306*b* and 306*c*, respectively. Each of the shafts carries a pulley 307*a*, 307*b*, 307*c*, 307*d*, 307*e*, 307*f*, and each of the pulleys has a plurality of paralell grooves of a semicircular section around it, as shown in FIG. 20. Those pulleys are grouped into three sets, each of which is connected by means of endless plastics ropes 308*a*, 308*b*, 308*c*, etc. which engage the corresponding grooves. Thus, each pair of pulleys connected by the ropes provide a different mass path. The gaps between the adjacent ropes form sieves. Those ropes across each pair of pulleys should provide an ascending path for the mass or contents traveling in the forward direction. Thus, the mass can travel smoothly. This ascending path should have an angle of 5 to 10 degrees, which provides the satisfactory results. On the opposite sides of the mass path, guides 309*a*, 309*b* are provided along which the mass can travel up. Beneath the path, there is a chute 309 through which the media are collected, which are delivered through a ball valve 310 and then through a conduit 311 to a vacuum tank.

According to the above-described construction, its operation is now described. The barrel container 14 which contains the mass to be separated is transferred to the mass separator F as indicated by an arrow 316, where the barrel container is reversed as indicated by an arrow 317, from which the contents are removed onto the plastics ropes 308*a*, etc. which are running in the direction of an arrow 313. While the mass is traveling on the first ascending path, part of the abrasive media is allowed to fall through the sieves defined between the adjacent ropes, and the works together with any remaining abrasive media are transferred onto the next ascending path. When the works are being transferred, they are tumbling along the pulley 307*b* down onto the next ropes so that the remaining media can be removed from the works. Finally, the media are completely removed from the works, which are transferred through a chute 314 onto a conveyer 315 which transports them to the next succeeding stage. The media are traveling through the chute 309 as indicated by an arrow 318, and are collected together below the chute, which are then delivered out of the system through the ball valve 310 and then through the conduit 311. For the dry media, a vacuum system may be employed.

As readily understood from the foregoing description, the mass separator comprises different levels of mass traveling paths each formed by parallel plastics ropes (such as urethan ropes) which define gaps between the adjacent ropes. Thus, the works can travel without striking against each other, which otherwise would produce defective works, such as physical injuries, indentations, etc. When the works are transferring from one path to another, they sustain a slight shock or tumbling, so that the media can completely be removed from the works. Thus, the satisfactory mass separation can be done.

The following description is provided for the media supply H that can deliver a measured quantity of abrasive media, by referring to FIGS. 21 through 24.

Figure 21:
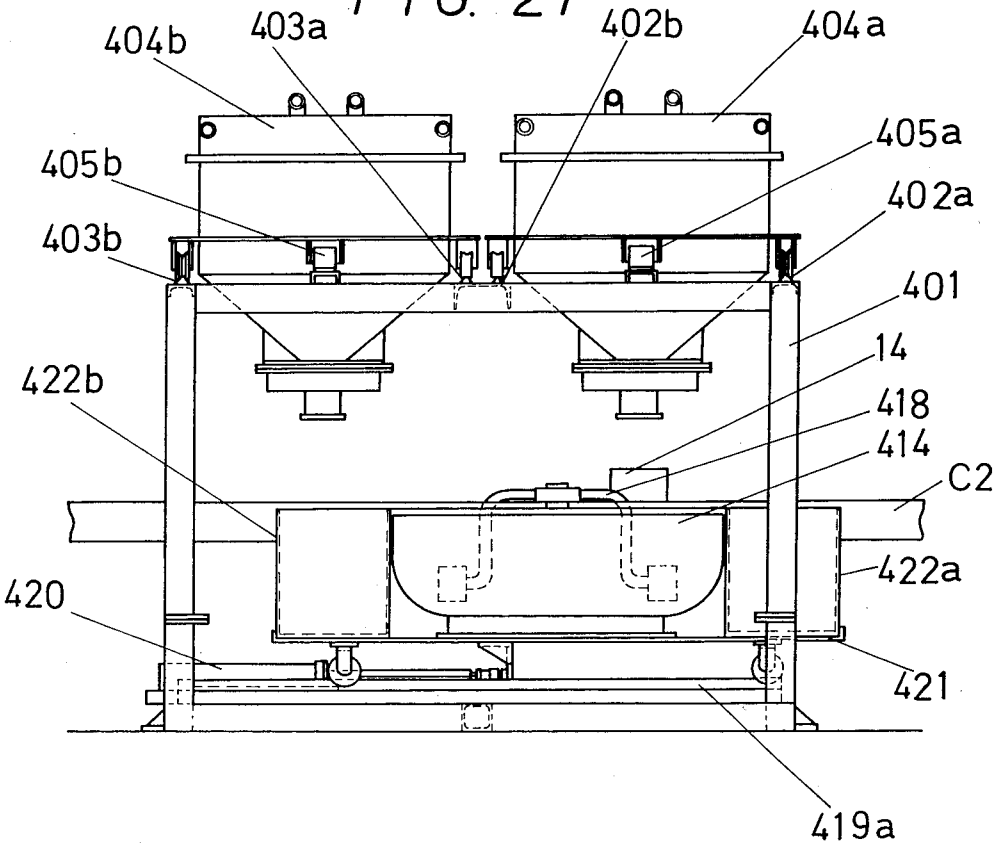
FIG. 21 is a front view of a media measuring and supplying device and a media blender.
Figure 22:
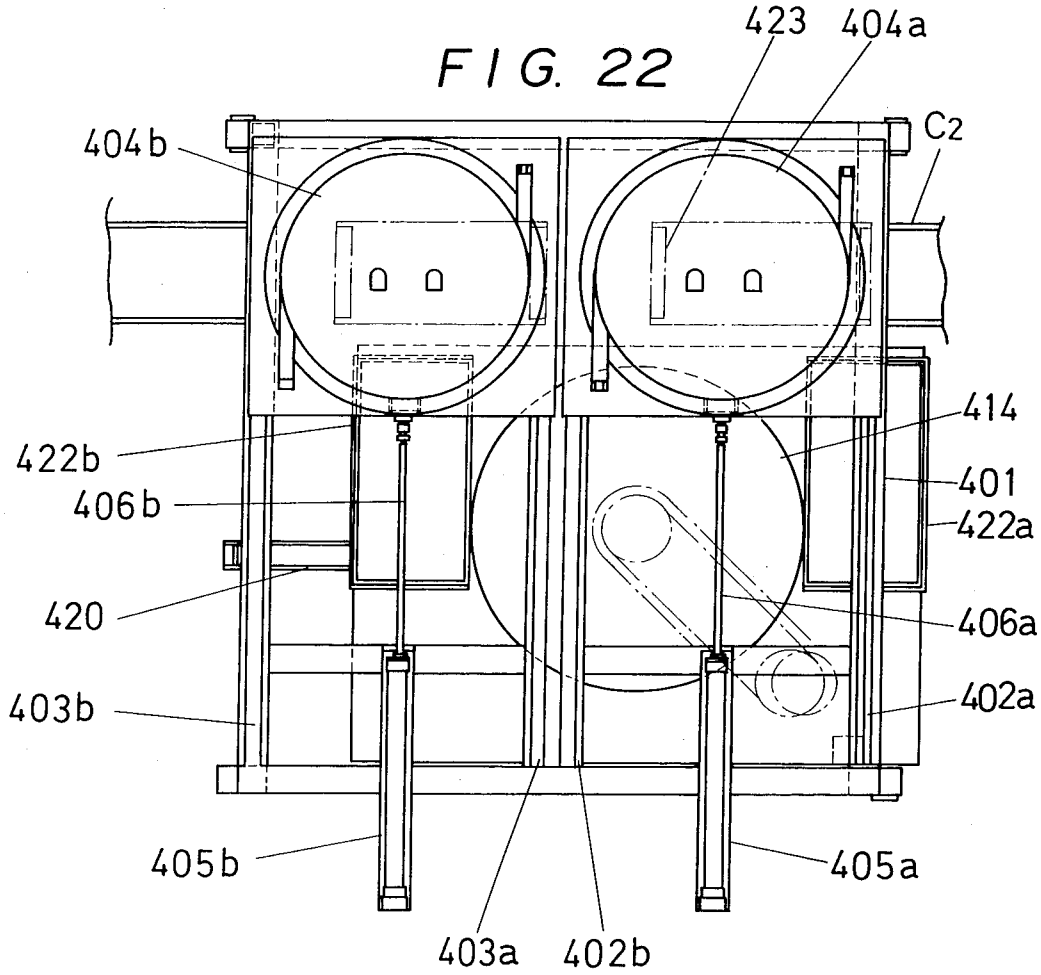
FIG. 22 is a plan view of the devices in FIG. 21.
Figure 23:
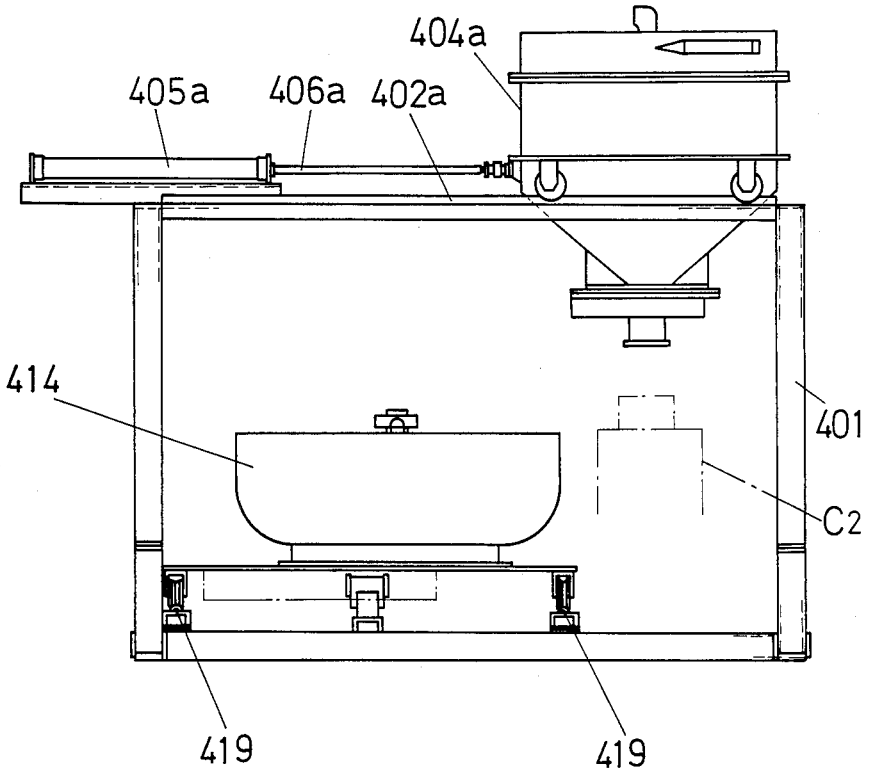
FIG. 23 is a side elevation of part of the devices in FIG. 21.
Figure 24:
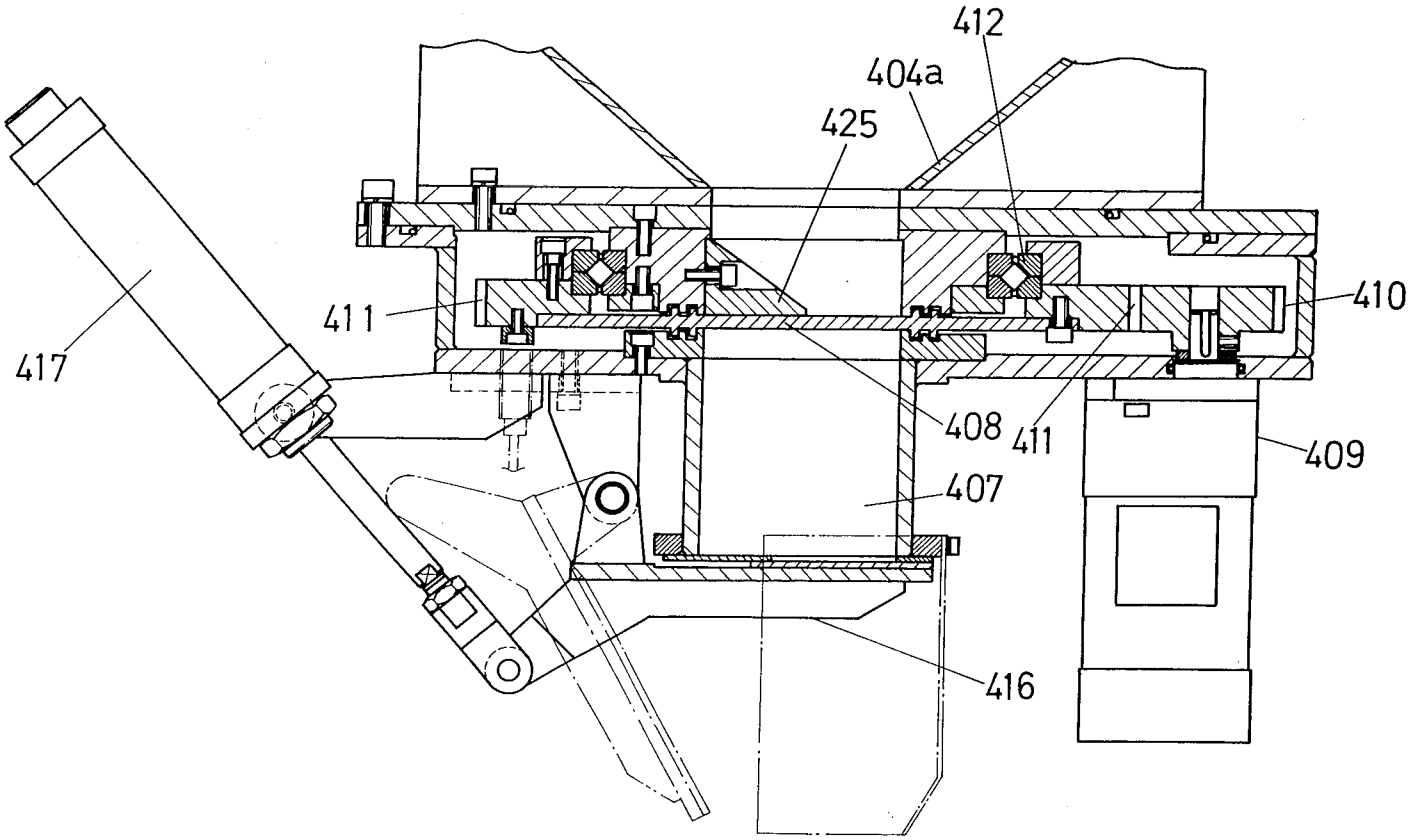
FIG. 24 is a partly enlarged sectional view showing details of the media measuring and supplying device.

The conveyer C2 is provided for transporting a barrel container to the media supply H and stopping it there. The main parts for the media supply are provided across the conveyer C2, as shown in FIGS. 21 and 22. Those parts are housed within a framework 401, on which two pairs of rails 402*a*, 402*b* and 403*a*, 403*b* are disposed, running across the conveyer path C2. A box 404*a*, 404*b* for containing abrasive media is equipped with four wheels, and can travel on the corresponding pair of rails. A fluid-operated cylinder 405*a*, 405*b* is mounted on the framework 401 for controlling the travel of the corresponding media box 404*a*, 404*b*. For this purpose, a piston rod 406*a*, 406*b* from the cylinder 405*a*, 405*b* is connected with the corresponding media box. The bottom of the media box is shown in detail in FIG. 24. As shown, its bottom is shaped like a funnel, below which a box 407 is provided for supplying a determined quantity of abrasive media. Between the outlet of the funnel and the inlet of the box 407, a dam 425 is disposed which covers part of the outlet of the funnel. The dam 425 has a semicircular shape that corresponds to half the opening of the funnel outlet, or larger sectorial shape. A rotary shutter 408 is interposed between the dam 425 and box 407, and is supported by a cross roller bearing 412 rotatably relative to the media box 404*a*, 404*b*. The rotary shutter 408 has an opening at the center, whose shape corresponds to that of the funnel outlet which is partly covered by the dam 425. That is, the opening for the rotary shutter 408 has the same shape as that portion of the funnel outlet not hidden by the dam 425. Rotating the shutter 408 allows the bottom opening of the media box 404*a*, 404*b* completely to be closed or to be opened to any desired size. The rotary motion of the rotary shutter 408 is provided by a combination of a gear 411 aligned with the shutter 408 and a pinion 410 which engages the gear 411. The box 407 for determining the quantity of media to be supplied has a cover 416 at the bottom thereof, which is opened or closed by a fluid-operated cylinder 417.

The type of abrasive media to be used for this embodiment is the dry abrasive media, which contains nutshells, corncobs (corn cores), wood chips, and plastics, to which abrasives, oils, etc. may be added as needed. This type of media becomes degraded after one cycle of the work finishing operation. For this reason, it is necessary to add activators such as abrasives, oils, etc. to the media that has once been used. When the media cannot be reused any longer, or when a new work finishing operation is begun, or when part of the used media must be replaced by additional media, a new media is used. The new media is conditioned by a media blender 414, which is described below. A new media is delivered through its port 413 and then through a vacuum system $G_2$ to the blender 414, where any required amount of abrasives and oils are added. The resulting media is then delivered to a agitator 418 where it is mixed and conditioned. The blender 414 travels on rails 491*a* and 419*b* under the control of a fluid-operated cylinder 420. The agitator 418 is mounted on its base 421, on which collector boxes 422*a*, 422*b* are also disposed. Those boxes are provided for collecting the non-reusable media. Then, the operation is described according to the above-described construction.

The dry media that has been separated from the works by the mass separator F is put into the media boxes 404*a* and 404*b* by means of a main vacuum system $G_1$. A plurality of individual barrel containers 14 that travel on a conveyer $C_2$ are arrested by the stopper which is described before so that they can stop in the positions as indicated by 423, just below the boxes 404*a* and 404*b*. In their stop positions, the media box 407 have their lids or covers 416 opened by the action of a fluid-operated cylinder 417 that is specifically provided for this purpose. Thus, a determined amount of media is placed into the barrel containers 14. After the media has been placed, the lids 416 are reclosed, and the rotary shutter 408 is rotated to allow that amount of media to be delivered into the box 407. The barrel container 14 that has now contained the media is then transferred on the conveyers C2 and C3 to the next succeeding stage. Two media boxes 404*a*, 404*b* at H are provided for meeting the requirements for the high-speed work finishing machine that includes a plurality of work finishing units to each of which a plurality of barrel containers are to be mounted. Thus, several barrel containers can be handled at one time, and the media feeding can be done in a short time. It should be noted, however, that the number of media boxes and media supplies may depend upon the number of barrel containers to be mounted per unit and the time intervals required for those barrel containers to arrive at those lolotions. During the normal cyclic operations, a dry media reconditioner is provided, which supplies additional abrasives and oils to the media that has been used for each work finishing operation, and mixes them together. Thus, the used media is reactivated. The media that has been reused for several hundred cycles will eventually become useless. When this occurs, a pressurized fluid is introduced into the piston rod side of either the fluid-operated cylinders 405a or 405b, or both, which causes the media boxes 404a and/or 404b to be retracted below in FIG. 22. Then, all or part of the media is collected into the media collector boxes 422a and/or 422b, and the corresponding amount of new media is delivered from the blender 414 into the media boxes 404a and/or 404b. This may be accomplished by using the vacuum system.

The media supply including its associated parts has been described, and when it is used, a determined amount of dry media can be supplied to the individual barrel containers traveling on the conveyer, and the media that has been degraded can be replaced by new media. The latter can be performed easily by using the media collector boxes and media blender.

Next, the feeder K that supplies a determined amount of additives is described. This feeder is provided for reactivating the media that has been used and degraded, by adding any required amount of abrasives and oils to the media and mixing them together.

Figure 25:
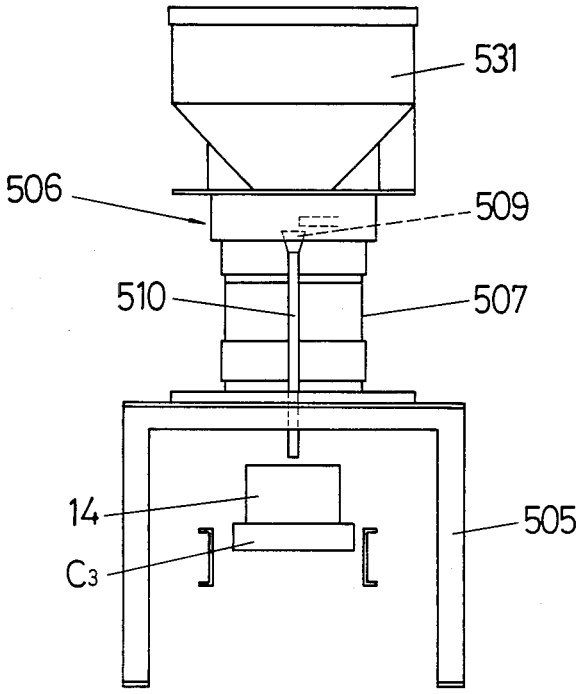
FIGS. 25 through 30 illustrate the reactivating substance measuring and supplying device, as designated by K in FIG. 1.
Figure 26:
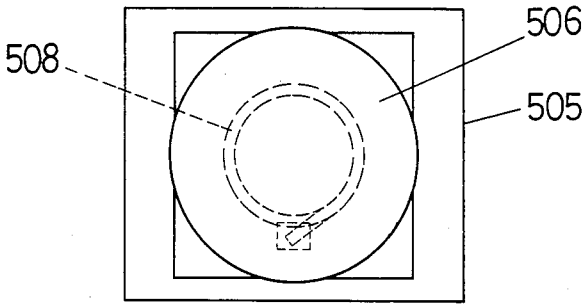

As shown in FIG. 25, a container that contains the used dry media travels on a conveyer C3. The container may be a barrel container or a different container that is specifically provided to receive such media from the barrel container. The feeder K includes a promoter feeder, a mixer, and an oil feeder which are arranged in succession. The container travels to the feeder station K, where it is stopped at each of the above locations by means of the known positioning devices. The construction of the promoter feeder is illustrated in FIGS. 25 and 26. In FIG. 25, a framework 505 is provided above and across the conveyer C3, on which a vibratory parts feeder 506 which is per se known is mounted. This parts feeder 506 contains a motor that causes both the rotary and vibratory motions. The materials that are contained at the bottom 507 of the feeder travel up along a spiral path 508 within the feeder during the rotary and vibratory motions caused by the motor. At the outlet 509, the materials are delivered through a conduit 510 into the barrel container 14 waiting on the conveyer C3. The amount of the materials to be fed is determined by the time interval during which the feeder is operational. Reference numeral 531 designates a hopper.

Figure 27:
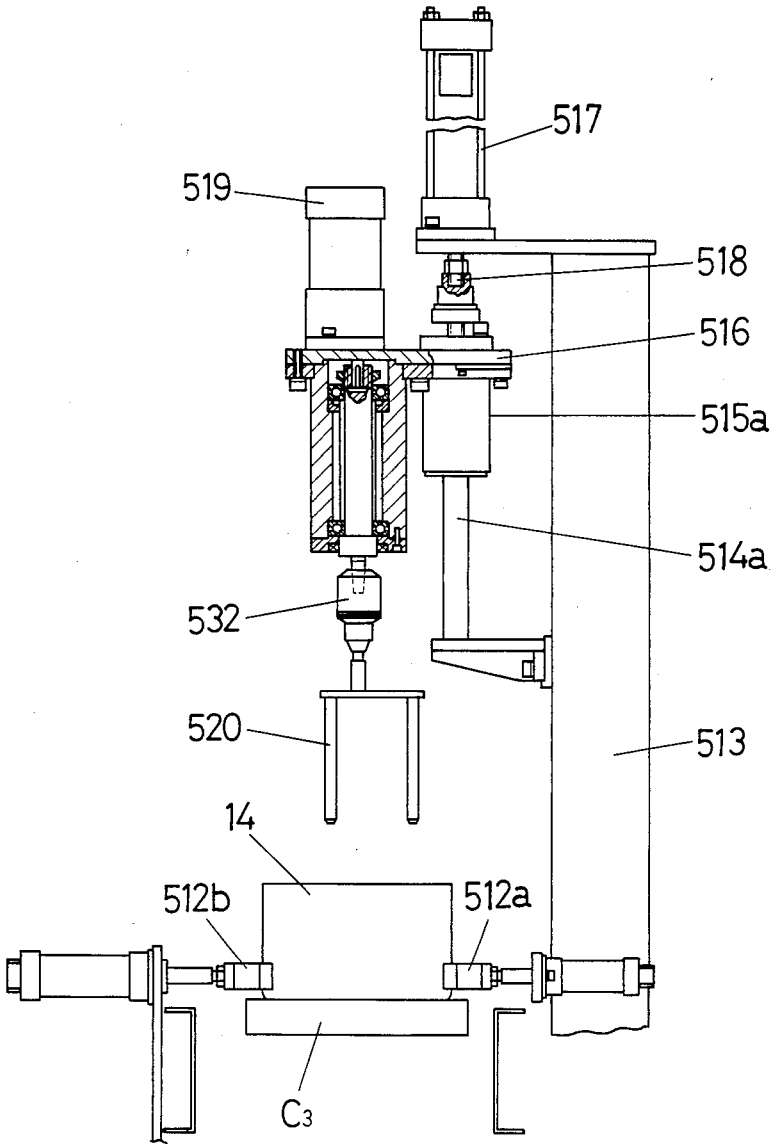
Figure 28:
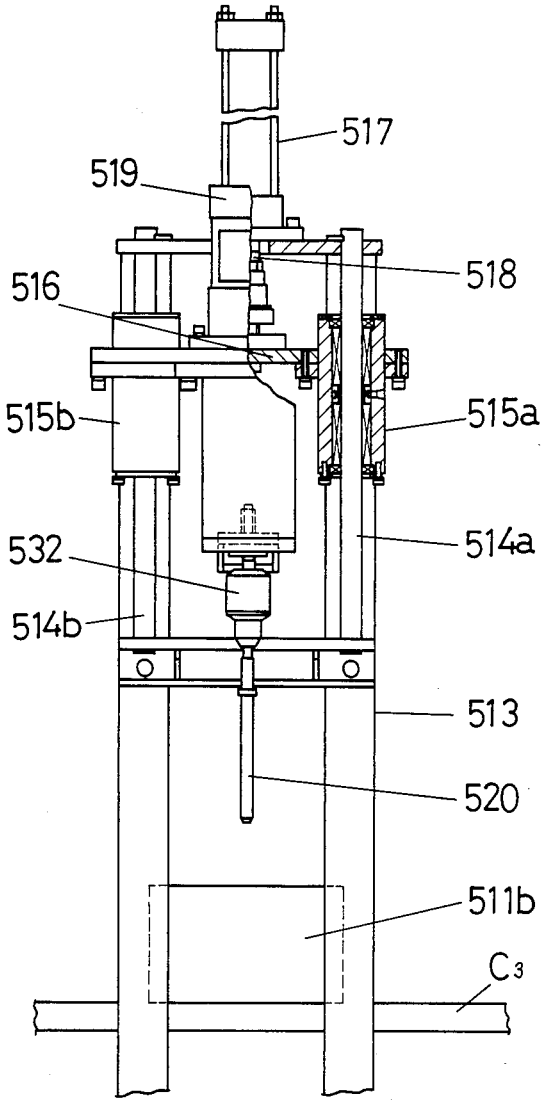
Figure 29:
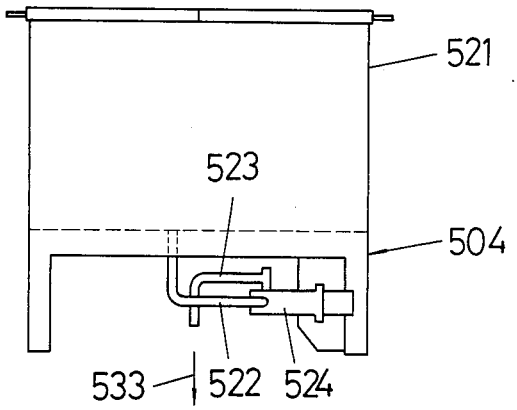
Figure 30:
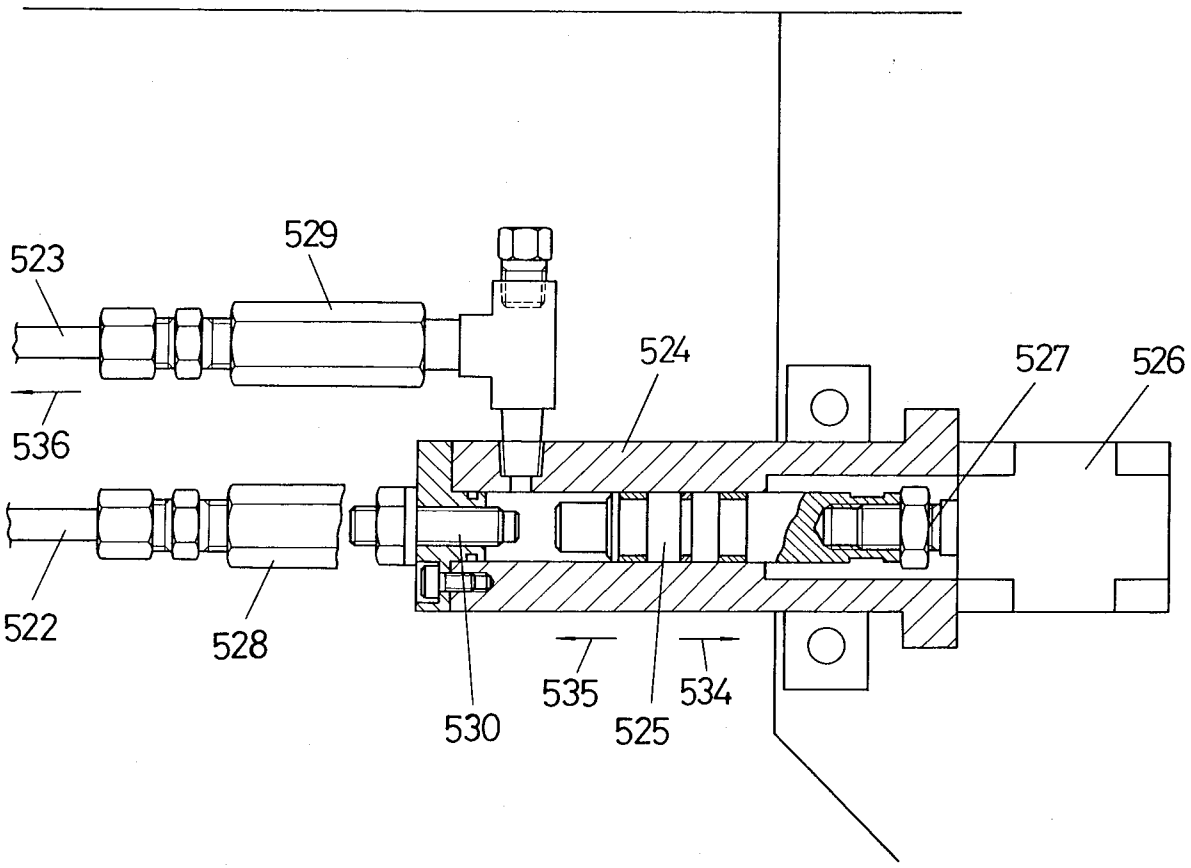
Figure 31:
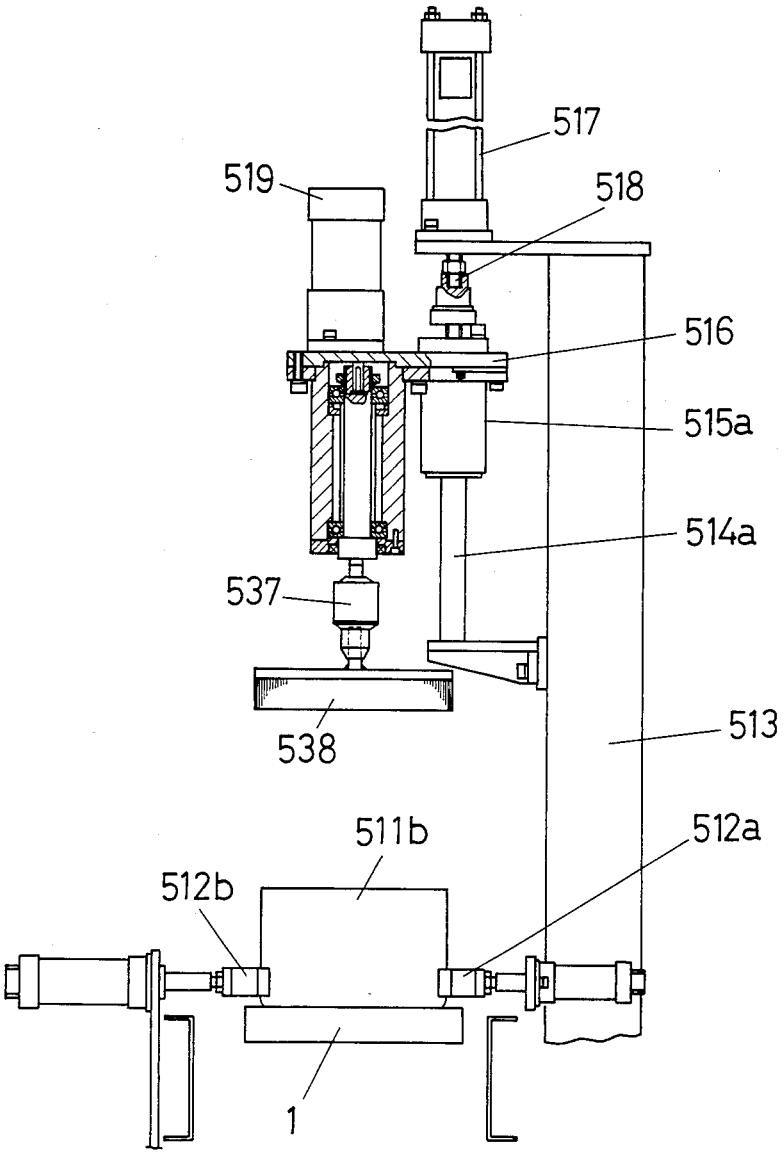
FIG. 31 is a front view of a device for brush-cleaning a barrel container flange.

The construction of the mixer is shown in FIGS. 27 and 28. It includes holders 512a and 512b, which hold the barrel container 14 from its opposite sides. FIG. 27 shows that the container is arrested in position. On one outer side of the conveyer, a support base 513 stands on the floor, from which two guide rails 514a and 514b extend upwardly in spaced relationship. A slider 515a, 515b is mounted on each of the guide rails, so that it can slide up and down along the corresponding guide rail. The sliders are connected by means of a center plate 516 which intervenes between them. A piston rod 518 from a fluid-operated cylinder 517 which is disposed above the center plate 516 is secured to the center plate. Thus, the center plate 516 can travel up and down with the piston rod 518 that retracts or extends from its cylinder. A stirring rod 520 is depending from the center plate 516, and is connected with a motor 519 by means of a coupler 532 so that it can be driven by the motor. When the barrel container 14 or 511b arrives at the location where the mixer is located, it is held by the holders 512a and 512b and stopped in position. Then, the stirring rod 520 which is now in its upper position is lowered by the action of the fluid-operated cylinder 517 until its forward forked ends are placed into the media within the container. Then, the motor 519 is started, causing the stirring rod 520 to rotate. Thus, the contents are mixed. When the mixing is completed after a prescribed time interval, the motor 519 is stopped, and the fluid-operated cylinder 517 is again operated to cause the stirring rod 520 to travel up to its upper position. Then, the holders 512a and 512b are operated to release the container 14 or 511b, which is then transferred to the next station. The next station is the oil feeder 504, which is shown in FIG. 29. As shown in FIG. 29, the oil feeder 504 includes an oil tank 521 which contains oil. The oil tank 521 is connected through a conduit 522 to an oil feed cylinder 524 which connects to another pipe 523. The oil is delivered from the pipe 523, as indicated by an arrow 533. The oil feed cylinder 524 has the construction as shown in FIG. 30. The cylinder accommodates a piston 525 that is capable of sliding motion inside the cylinder, whose one end is connected to the corresponding end of a piston rod 527 from a fluid-operated cylinder 526. The conduit pipes 522 and 523 communicate with the cylinder 524 through the different openings provided on the end thereof. Each of the pipes is equipped with a check valve 528 or 529 which prevents the oil from flowing back. When the piston rod 527 moves toward the right as indicated by an arrow 534 in FIG. 30, the oil in the tank 521 is introduced through the conduit 522 into the cylinder 524. When the piston rod moves toward the left as indicated by an arrow 535, the cylinder 524 communicates with the pipe 523, through which the oil in the cylinder is fed into the container 14 or 511b, as indicated by an arrow 536. During the above operation, a determined amount of oil is delivered from the tank into the cylinder, and the corresponding amount of oil is fed from the cylinder into the container. The cylinder 524 includes a stopper 530 that controls the amount of oil to be fed. The stroke of the piston can be varied by sliding the stopper 530 longitudinally, and the amount of oil to be fed can be regulated accordingly. The container into which the oil has been fed is then transferred to the next stage.

In the above description, the promotor feeder precedes the oil feeder, but this preceding promotor feeder may be located following the oil feeder. One mixer is followed by the promotor feeder, but this mixer may be located following the oil feeder, instead. Or, two mixers may be used. In this case, one mixer may follow the promotor feeder, and the other may follow the oil feeder. Following those feeders, a brush cleaner L is provided which cleans the flange for the barrel container by using the brush. The purpose of this brush cleaner is to remove any deposits that may remain on the barrel flange after the used media is removed from the barrel container or after an additional media or other additives are placed into the barrel container. Thus, the barrel container can be kept hermetic by removing such deposits. The construction of the brush cleaner is similar to the mixer shown in FIG. 27, except that a brush 538 is used in place of the stirring rod 520. The brush cleaner also operates in the same manner as the mixer, and its description is omitted. The parts for the brush cleaner have the same reference numerals as the corresponding parts for the mixer.

A series of the feeders that have been described allow the appropriate amounts of new dry media as well as any required additives such as oil to be placed into the barrel container in the automatic sequence. In this way, the automatic media reconditioning can be achieved, and the same media can have a longer life and can be used repeatedly for many cyclic operations.

Figure 32:
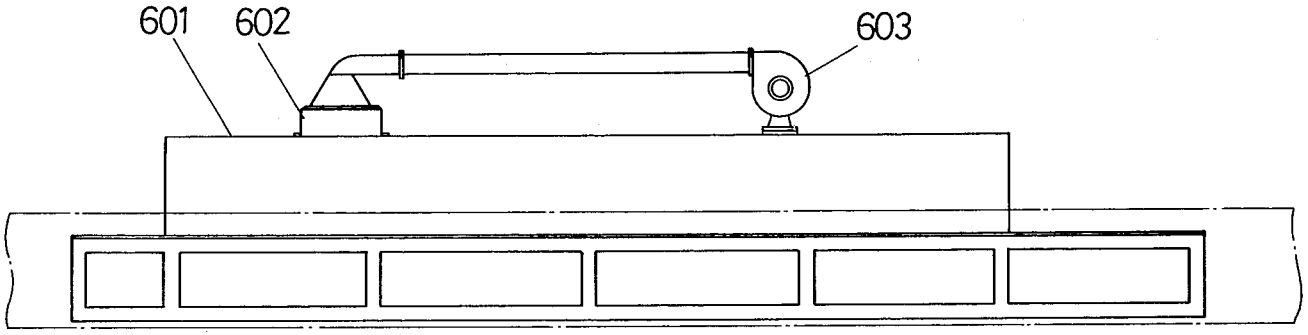
FIGS. 32 and 33 illustrate a media heating device.
Figure 33:
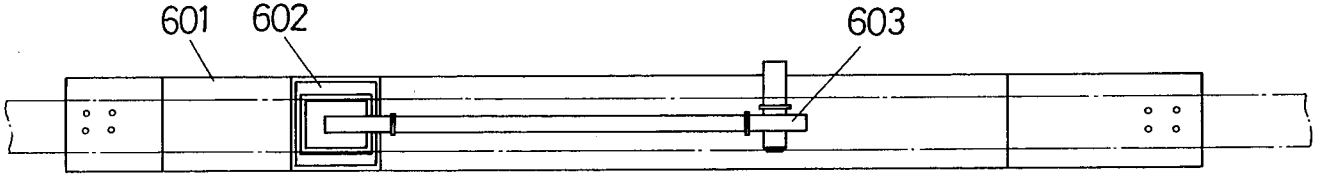

The next stage is a media heater which consists of several units M1, M2, M3 and M4. The purpose of those media heating units is to heat the media to a proper temperature, which is required to allow the media to provide the optimum work finishing efficiency. Under the situation where the media is not heated, it is cold at the initial stage of the work finishing process, and it is getting warmer as the process proceeds. This would cause the media to provide the irregular finishing efficiency. Totally, its efficiency would be reduced. The media heater has the construction as illustrated in FIGS. 32 and 33. As shown, the heater includes a plurality of heating units M1, M2, M3, and M4, which are all similar in the construction. Therefore, one of those units such as M1 is described below. A heating casing 601 surrounds the conveyer C3, above which a heat supply source 602 is disposed. The heat supply source 602 may be provided as a water warmer, steamer, or electric heater, and in this example, the steamer which is usually employed in most industrial applications is used. The type of the steamer used is the steam warming radiator. The reasons for using the steam are that the steam can provide the temperature that is adequate to maintain the media under the optimum temperature requirements such as 80° C., and that the steamer permits easy cleaning and temperature adjustment. The steam from the heater source is blown by a fan 603 into the heating casing 601, thus heating the interior of the casing. A steam inlet/outlet may be provided as needed. In this case, a photoelectric switch may be mounted on the inlet/outlet so that it can be sensitive to the presence or absence of a barrel container, thus opening or closing the inlet/outlet. In this way, the heating efficiency can be improved.

The preceding description has been made for the particular example where the dry-type media is used. Those devices that are specific to such media may only be modified slightly to permit use of the wet-type media. For the wet-type media, the known vitrified or ceramics substances are used as binders, rather than the organic substances. Those binders bind abrading materials into small-sized abrasives. Also, a compound solution is used instead of oil. When the wet media is used, therefore, the media blender J and media heating units M1, etc. may be omitted. Furthermore, the media promoter feeder and mixer that are located within the additive feeder station K may also be omitted, and the oil feeder may be replaced by a compound solution feeder. The compound solution feeder uses the water washing flush, which is per se known and therefore requires no further description. The vacuum system that is used to transport the used media from the mass separator to the media feeder H may also be used as in the shown example, but it may usually be replaced by the bucket conveyer, which is also known by itself and therefore requires no further description.

Figure 34:
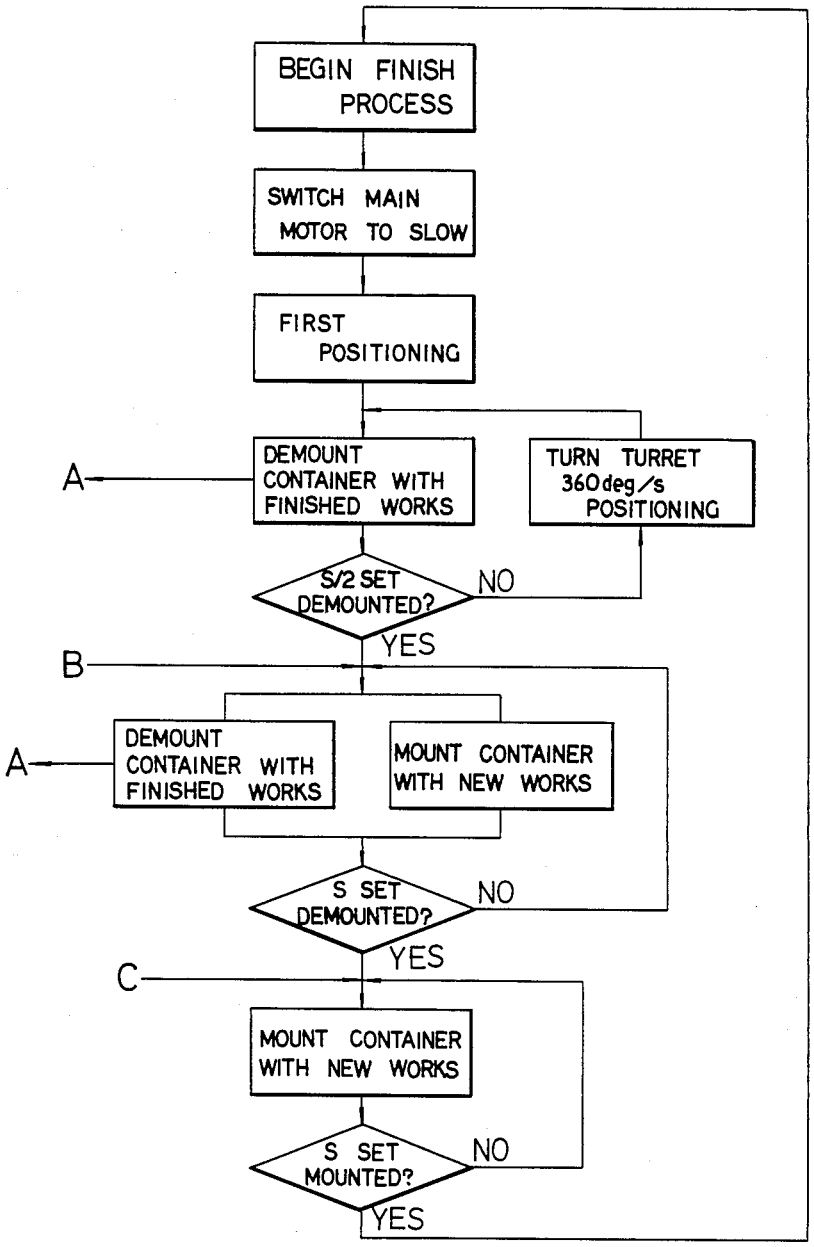
FIG. 34 is a flowchart of the sequential control steps for each device.
Figure 35:
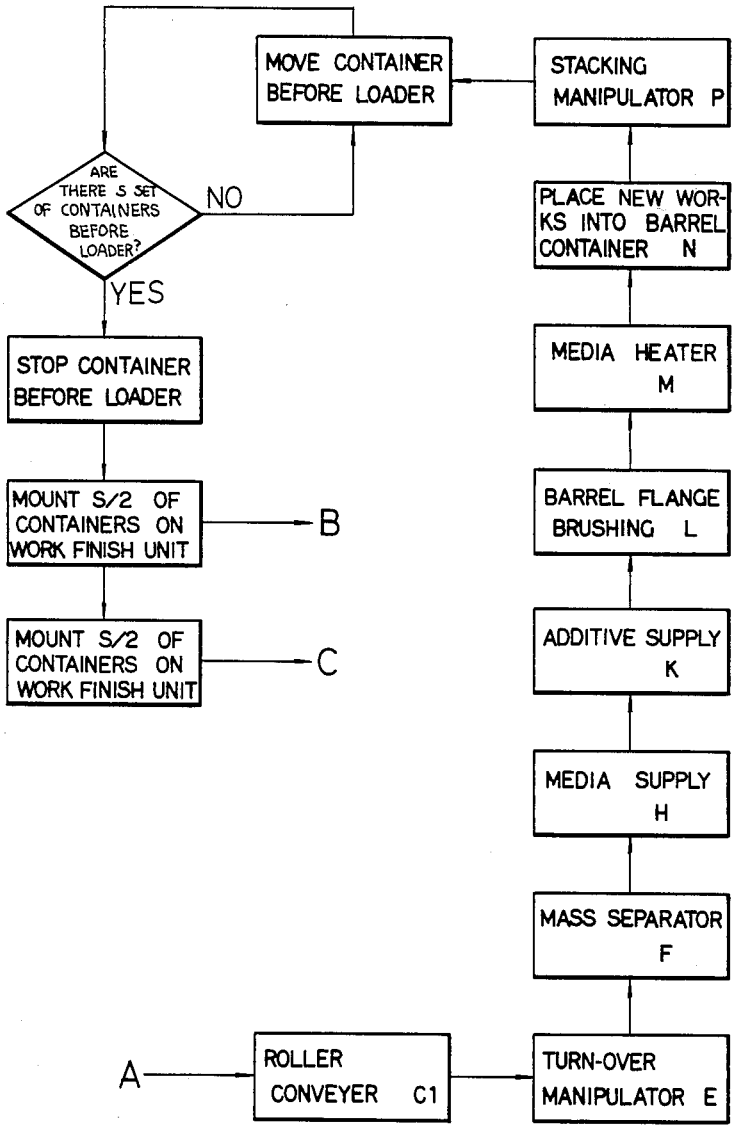
FIG. 35 is a flowchart of the steps, each step representing each motion of a barrel container.

All of the devices that have been described can be operated automatically under the control of the central sequencer, without any human operator intervention. In the example shown and described, all the devices including the individual work finishing units are controlled by the Mitubishi general-purpose sequencer "MELSEC-KOJ2PDR" which is offered by Mitubishi Electric Co., Japan. The main controller "MELSEC-K3CPUP2" which is also offered by the above company receives control signals from the sequencer that provides the sequential control functions for each work finishing unit and its associated devices. The control signals from the sequencer include online, finishing-in process, no barrel container on the unloader, no barrel container on the loader, a barrel container before the loader, automatic operation mode, finishing ready state, request for lowering the unloader stopper to the following unit, request for raising the unloader stopper to the preceding unit, abnormal situation, etc. The sequencer and main controller are connected by an optical cable, and the main controller provides instructions for the sequencer, such as automatic start, end of finish operation, discharge, loader accept, loader pass, request for lowering the unloader stopper to the following unit, request for raising the unloader stopper from the preceding unit, request for lowering the unloader stopper from the preceding unit, emergency stop, etc. The flowchart in FIGS. 34 and 35 depicts the general step-by-step operation for a barrel container. The barrel container goes through the different locations under the control of the sequencer and main controller according to the steps given in the flowcharts, where the barrel container is handled as appropriate. Those steps are automatically performed in the unattended mode. At the locations E to P in FIG. 35, the stopper ahead of each device is automatically operated to allow the barrel container to pass when the device is ready to accept it.

All the operations that involve manipulating a barrel container are performed sequentially. For example, one set of barrel containers that contain just finished works are removed on one side from a given work finishing unit while another set of barrel containers that contain works next to be finished are to be mounted onto the same work finishing unit on the opposite side. The circular conveyer system connects the loading side and unloading side of each work finishing unit, and the locations where the mass is handled, such as the removal, separation, and placement of the mass, are arranged on the way between the loading and unloading locations. All the operations associated with the above locations can also occur automatically and without the operator intervention.

Although the present invention has been described with reference to the everal preferred embodiments thereof, it should be understood that various changes and modifications may be made without departing from the spirit and scope of the invention.

What is claimed is:

1. A high-speed work finishing machine including a high-speed turret and stacked individual barrel containers each containing flanged a mass of workpieces to be surface-finished and abrasive media used for the work-surface finishing, the barrel containers being supported by the high-speed turret and their respective shafts for both orbital and axial rotations, thereby subjecting the said mass to the produced centrifugal forces and forming a sliding layer on the mass, thus causing a relative motion between the workpieces and abrasive media thereby to allow the workpieces to be surface-finished by the abrasive media, the high-speed work finishing machine comprising:

a series of work finishing units each supported by its own high-speed turret;

individual barrel containers demountably mountable onto respective work finishing units;

first means for manipulating the barrel container on one side and the opposite sides of each work finishing unit, for loading and unloading the barrel container to and from the work finishing unit;

circulating transport means for conveying the barrel container between the loading and unloading manipulator means;

second manipulator means for unstacking the multiply-stacked barrel containers, mass separator means for separating the surface-finished workpieces and the used abrasive media, media supplying means for supplying a specific amount of new abrasive media, media blending means, additive supply means for supplying a specific amount of additives, brush-cleaning means for cleaning the flange of the barrel container, media heating means, means for feeding workpieces next to be surface-finished into a barrel container, and third manipulator means for stacking multiple barrel containers one on another, all or part of which are arranged in the above-listed order on the way of the circular transport means; and sequential control means for controlling the operations of all the above-listed means.

2. A high-speed work finishing machine as defined in claim 1, wherein the abrasive media includes a dry-type abrasive media or a wet-type abrasive media.

3. A high-speed work finishing machine as defined in claim 1, wherein a single barrel container is demountably mountable on a work finishing unit.

4. A high-speed work finishing machine as defined in claim 1, wherein multiply-stacked barrel containers are demountably mountable on a work finishing machine.

* * * * *